US007104323B2

(12) United States Patent
Cook et al.

(10) Patent No.: US 7,104,323 B2
(45) Date of Patent: Sep. 12, 2006

(54) SPIRAL TUBULAR TOOL AND METHOD

(76) Inventors: Robert Bradley Cook, 304 Scotchpine Dr., Mandeville, LA (US) 70471; Glenn Mitchel Walls, 7 Begonia Dr., Covington, LA (US) 70433

( * ) Notice: Subject to any disclaimer, the term of this patent is extended or adjusted under 35 U.S.C. 154(b) by 0 days.

(21) Appl. No.: 10/612,726

(22) Filed: Jul. 1, 2003

(65) Prior Publication Data

US 2005/0000692 A1 Jan. 6, 2005

(51) Int. Cl.
*E21B 23/01* (2006.01)

(52) U.S. Cl. ..... 166/278; 166/285; 166/311; 166/381; 166/386; 166/51; 166/55; 166/192; 166/227

(58) Field of Classification Search ..... 166/278, 166/285, 311, 386, 51, 55.1, 55, 118, 119, 166/135, 138, 192, 170, 173, 174, 207, 217, 166/231, 227, 381, 277
See application file for complete search history.

(56) References Cited

U.S. PATENT DOCUMENTS 3,314,479 A 4/1967 McCullough et al.
3,706,342 A * 12/1972 Woolley ..... 166/135
3,891,034 A 6/1975 Owen et al.
4,491,178 A 1/1985 Terrell et al.
4,501,327 A * 2/1985 Retz ..... 166/285
6,896,052 B1 * 5/2005 Simpson et al. ..... 166/207
6,904,974 B1 * 6/2005 Slack ..... 166/207

* cited by examiner

*Primary Examiner*—David Bagnell
*Assistant Examiner*—Matthew J. Smith
(74) *Attorney, Agent, or Firm*—C. Dean Domingue; Robert L. Waddell; Ted A. Anthony

(57) ABSTRACT

An expandable device for use in tubulars. The device comprises an outer tubular having a series of slots therein, with the slots being arranged about the exterior of the outer tubular. The device further includes an inner tubular disposed within the outer tubular, and a setting tool for moving the outer tubular in a first direction in order to expand the outer tubular along the slots. In one preferred embodiment, the slots are arranged about the outer tubular in a spiral pattern. In yet another preferred embodiment, the slots are arranged about the outer tubular in a first spiral pattern and wherein the first spiral pattern extends to a second spiral pattern. The setting tool, in one embodiment, comprises an outer setting sleeve connected to the outer tubular and a mandrel being connected to the inner member, and wherein the outer setting sleeve causes a downward force against the outer tubular so that the outer tubular expands. A method of expanding a device within a tubular is also disclosed.

35 Claims, 19 Drawing Sheets

SPIRAL TUBULAR TOOL AND METHOD

BACKGROUND OF THE INVENTION

This invention relates to a device that has an outer diameter portion that can be expanded. More particularly, but not by way of limitation, this invention relates to a device that can be expanded from a first outer diameter to a second outer diameter so that the device engages a tubular member. A method of expanding a device within a tubular string for well work is also disclosed.

In the drilling, completion and production of wells, tubular strings, such as casing strings, are placed within a well. The tubulars placed within the well are often times of small inner diameter. Additionally, it is necessary to place concentrically within the well other tubulars, as is readily understood by those of ordinary skill in the art. Further, deviated wells and horizontal wells are being drilled at an increasing frequency, and these wells may have very small inner diameters.

The tools that are lowered into these tubulars are required to be of smaller outer diameter than the inner diameter of the smallest tubular within the well. In cases where a concentric tubular terminates within a well, the effective inner diameter increases. However, the tool that is initially placed into the well must be of a small enough outer diameter to be lowered through the smallest diameter tubular. Once the tool is lowered into the larger diameter tubular to the desired level, the tool's outer diameter can be enlarged.

As those of ordinary skill will appreciate, a small diameter tool within a larger diameter tubular may have certain limitations and disadvantages such as centralization, ability to expand, ability to engage, functionality, etc. For instance, a thru-tubing packer, due to the initial limited size, may be restricted in its ability to expand large enough to engage, anchor and/or seal within the tubular that it is ultimately expanded within.

Therefore, there is a need for a tool that can be passed through tubulars with restrictions therein, and the outer diameter of the tool can be expanded at a desired position in the tubular. There is also a need for a tool that can be passed through a tubular with a small inner diameter and wherein the tool can be expanded to engage the walls of a second larger tubular. The expandable tools can be used in several applications related to remedial well work. These, and many other needs, will be met by the invention herein disclosed, which will become apparent from a reading of this specification.

SUMMARY OF THE INVENTION

A device for use in a casing is disclosed. The device comprises an outer tubular having a series of slots therein, with the slots being arranged about the exterior of said outer tubular. The device further includes an inner tubular disposed within the outer tubular, and means for moving the outer tubular in a first direction in order to subject the outer tubular to a downward force thereby expanding the outer tubular along the slots.

In one preferred embodiment, the slots are arranged about the outer tubular in a spiral pattern. In yet another preferred embodiment, the slots are arranged about the outer tubular member in a first spiral pattern and wherein the first spiral pattern extends to a second spiral pattern.

The moving means, in one embodiment, comprises a setting tool that has an outer setting sleeve connected to the outer tubular and a mandrel being connected to the inner tubular, and wherein the outer setting sleeve causes a downward force against the top end of the outer tubular and wherein the mandrel causes an opposing force against the bottom end of the outer tubular so that the outer tubular expands. In another preferred embodiment, the moving means includes a hydraulic setting apparatus comprising: an outer setting sleeve connected to the outer tubular; a mandrel being connected to the inner tubular; a chamber positioned between the outer tubular and the inner tubular; and wherein hydraulic pressure enters the chamber causing the outer setting sleeve to move downward so that the outer tubular expands.

The device may further include a ratchet means, disposed between the outer tubular and the inner tubular, for allowing movement in a first direction but preventing movement in a reverse direction. Additionally, the device may contain a stroke limit ring means for limiting the amount of compression on the outer member. Also, the device may include a cover member disposed about the outer tubular.

In another embodiment, the device contains a one-way valve within the inner portion so that a flow stream from the casing is allowed to flow in a first direction but is precluded from flowing in a second direction.

A method of expanding a device within a casing is also disclosed. The device comprises an outer tubular having a series of slots therein, with the slots being arranged about the exterior of the outer tubular, and wherein the exterior has a first outer diameter. The device further includes an inner tubular disposed within the outer tubular. The method comprises placing the device at the desired level within the casing. The outer tubular is moved in a first direction in order to subject the outer tubular to a downward force. Next, the outer tubular is expanded along the slots. The expansion of the outer tubular contacts the outer tubular against the wall of the casing. In one embodiment, the bands of the outer tubular cover completely the annular area.

In one of the preferred embodiments, the device further comprises a ratchet means, disposed between the outer setting sleeve and the mandrel, and the method further comprises allowing movement in a first direction but preventing movement in a reverse direction. The device may also contain a stroke limit means, and the method further comprises limiting the amount of compression on the outer member. Additionally, in one of the embodiments disclosed, the device further includes a setting apparatus comprising: an outer setting sleeve connected to the outer tubular; a mandrel being connected to the inner tubular; and wherein the step of moving the outer sleeve comprises moving the outer sleeve downward so that the outer diameter of the outer tubular is expanded to engage the walls of the casing.

In one of the embodiments, the spirals are arranged in a first pattern. In a second embodiment, the spirals are arranged in a first pattern and then extend to a second pattern. In one of the preferred embodiments, the method includes lifting the device within the casing and cleaning the walls of the casing with the expanded outer tubular. Additionally, the outer tubular may contain an elastomeric member disposed about the outer diameter and the step of expanding the outer diameter of the outer tubular to engage the walls of the casing further comprises sealingly engaging the elastomeric member against the wall of the casing.

A method of setting a plug within a casing is also disclosed. The plug includes a first anchoring device operatively associated with a second anchoring device. The first anchoring device may contain a plurality of extendable arms. The second anchoring device comprises an outer tubular member having a series of spiral slots arranged about the exterior, and an inner tubular member disposed within the outer tubular member.

The method comprises lowering the plug to the desired level and setting the first anchoring device at the desired level by extending the plurality of arms to engage the wall of the casing. The method further includes moving the outer tubular member in a first direction in order to subject the outer tubular member to a downward force. Next, the method includes expanding the outer tubular member along the slots and engaging the outer diameter of the outer tubular member against the inner wall of the casing.

In one of the preferred embodiments, the spiral pattern is arranged in a first direction. In another preferred embodiment, the spiral pattern is arranged in a first spiral direction that extends to a second spiral direction. In one of the preferred embodiments, the method includes pumping a slurry onto the plug, or dumping a slurry onto the plug via a dump bailer.

A method of gravel packing a subterranean zone penetrated by a casing is also disclosed. The method comprises lowering an anchoring device to the desired level. The anchoring device includes an outer tubular member having a series of slots arranged about the exterior of the outer tubular member in a spiral pattern. The anchoring device also includes an inner tubular member disposed within the outer tubular member, with the anchoring device having a gravel pack screen attached at a distal end.

The method further comprises placing a gravel pack slurry into the annulus of the casing. Next, the method includes moving the outer tubular member in a first direction in order to subject the outer tubular member to a downward force. The outer tubular member is expanded along the slots, and the outer diameter of the outer tubular member engages against the inner wall of the casing.

In another gravel packing method, a gravel pack screen is placed within the casing thereby forming an annulus. Next a gravel pack slurry is placed about the gravel pack screen. An anchoring device is lowered to the desired level and latched into the top of the gravel pack assembly. The method includes moving the outer tubular member in a first direction in order to subject the outer tubular member to a downward force, thereby expanding the outer tubular member along the slots and engaging the outer diameter of the outer tubular member against the inner wall of the casing.

In one of the preferred embodiments, the anchoring device has a cover member disposed about the outer tubular member and wherein the step of engaging the outer diameter of said outer tubular member against the inner wall includes engaging the cover against the inner wall. In one embodiment, the cover is made of a permeable material and the method further comprises flowing a portion of a production stream from the subterranean zone through the permeable material and flowing the remaining portion of the production stream through an inner bore of the anchoring device.

In another preferred embodiment, the cover is made of an impermeable material and the method further comprises sealingly engaging the impermeable material against the wall of the casing. A production stream, from the reservoir, is flown from the subterranean zone through an inner bore of the anchoring device.

Another apparatus for setting within a tubular is disclosed. The apparatus comprises a first anchor member and a second anchor member with the second anchor member being operatively associated with the first anchor member. The apparatus further includes setting tool means for setting the first anchor member and the second anchor member. The second anchor member may have contained thereon a plurality of slots formed in a spiral pattern. In one embodiment, the first anchor member has a first inner member and a first outer member and wherein the second anchor member has a second outer member attached to the first outer member and a second inner member attached to the first inner member and wherein the setting tool means includes means for moving the first and second outer members in a first direction and means for moving the first and second inner members in an opposing direction.

An advantage of the present invention includes the ability of the device to be used in several applications. Many different types of applications utilizing the present inventions are possible. For instance, the expandable device may be used, as previously noted, as a thru-tubing bridge plug. The expandable device could be set on electric line, wireline or it could be set on a pipe. The expandable device could be a "non-vent" wherein it is used as a platform for placement of cement/bridging type material. Alternatively, the expandable device may contain a vent valve to allow pressure movement through the center bore during cement cure.

Also, an application would be using the expandable device to locate a bottom hole assembly at a precise depth. For instance, it could be used for perforating, pressure gauges, and gravel pack assemblies, wherein the perforating guns, pressure gauges or gravel pack assemblies are hung-off the device or set on top. The expandable device may be run with or without an elastomeric member (also referred to as an elastomer). As previously noted, when run with elastomeric cover it is possible to affect a hydraulic seal. This hydraulic seal holds a liquid or gas column without the need for additional runs to place bridging material in order to seal.

Another application would be used as a thru-tubing packer with a bore through the center. For example, these types of packers could be used in production operations. Additionally, the expandable device can be run as two packers (straddled). An application using these straddle type packers would be in conjunction with operations to cover a hole in a down hole tubular. Another application using the straddle type packers would be, for instance, production tubing wherein a set of perforations is making water or other unwanted production. Cement is placed on top of the packer in the annular area. The lower zone is now produced free of unwanted production. Therefore, this is useful with multiple zones or zone with stringers of water production. Additionally, this thru-tubing expandable packer could be used to have operatively associated therewith a down hole choke, a landing profile, a flow diverter, a big bore packer, or a hanger for a velocity string, guns, gauges, or gravel pack assembly with screen, etc.

The expandable device could also be used as a thru-tubing retainer with a one-way check valve. These retainers can be used for cementing, acidizing and other types of remedial well work.

Still yet another additional application of the expandable device would be for use as a tubing stop which functions as a locator in the well. Additionally, another application with the expandable device would be as a mechanical anchor. It is possible that the outer diameter of the expandable device could be knurled before the slots are cut, or have gripping material attached. This enhances the anchoring effect that the expandable device has with the wall of the well bore. Yet another application would serve as a thru-tubing centralizer.

Another application of the present invention includes use as a casing, tubing, flow-line, or pipeline cleaner/scraper/wiper. It is possible to run the expandable device into a well, and wherein the expandable device contacts the walls of the tubular. The operator either lifts or lowers the expandable device thereby providing the cleaning function. When lifting, the work string is pulled upward. When lowering, the operator would impart a jarring impact on the device. It is possible to use the elastomeric member with this scraper device, as well as placement of bristles on the outer diameter of the expandable device. Further, it is contemplated that an application can include a hydraulic model that can be pumped through a tubular in order to clean casing, tubing, pipeline or flowline.

Yet another application would include use as a vent screen packer. As those of ordinary skill in the art will appreciate, a vent screen is a gravel pack method where a screen assembly is placed in the well bore and the sand slurry that is later pumped. The screen assembly consists of the section of screen to cover the production interval, a section of blank pipe and another section of screen. The section of blank pipe must be long enough for a sufficient height of sand to be left above the top perforation and below the upper string section. The pressure drop and permeability loss through the section of sand is sufficient to keep the production flow into the gravel pack screen across from the perforations rather than up the annulus area. Once the production enters the inner diameter of the gravel pack screen, the production travels through the blank pipe and out the upper screen to make its way to the production tubing. A vent screen does not normally have a packer installed. However, if the sand column has voids, the pressure drop is not sufficient and the sand can be produced up the annulus and eliminate the gravel pack. A packer would eliminate the possibility if it were to be set atop the vent screen assembly after pumping the sand. Other reasons would be lack of room before the next zone or before the mechanical restrictions (ergo, end of tubing) to build sufficient sand height. Accordingly, the vent screen packer can be run on the gravel pack screen assembly and set after pumping the sand. It could also be run on a separate trip either on wireline or pipe. Additionally, cement can be added to make it a permanent packer.

A feature of the present invention is that the slots can be cut in a spiral pattern about the outer tubular. Another feature is that the slots can be cut in a first spiral pattern which extends to a second spiral pattern. It should be noted that other patterns for slots exist, with the actual pattern depending on many types of variables, for instance wall thickness of the outer tubular, amount of radial expansion required, specific use of device, etc. Another feature includes the ability to concentrically place a second, internal, spiral tool within a first spiral tool. The concentrically placed second spiral tool aids in allowing complete annular coverage once set within a tubular.

Still yet another feature is that the outer tubular containing the slots can be expanded using known techniques such as a mechanical setting device, a hydraulic setting device, or explosive setting device. Another feature is that an elastomeric member can be placed about the outer tubular. Yet another feature is the stroke limit means which limits the amount of compression on the spiral device. Also, a ratchet mechanism can be included to aid in proper setting of the device and to prevent the premature unseating of the device once set. Other features and advantages will be evident from a reading of the detailed description, set out below.

DETAILED DESCRIPTION OF THE PREFERRED EMBODIMENTS

Figure 1A:
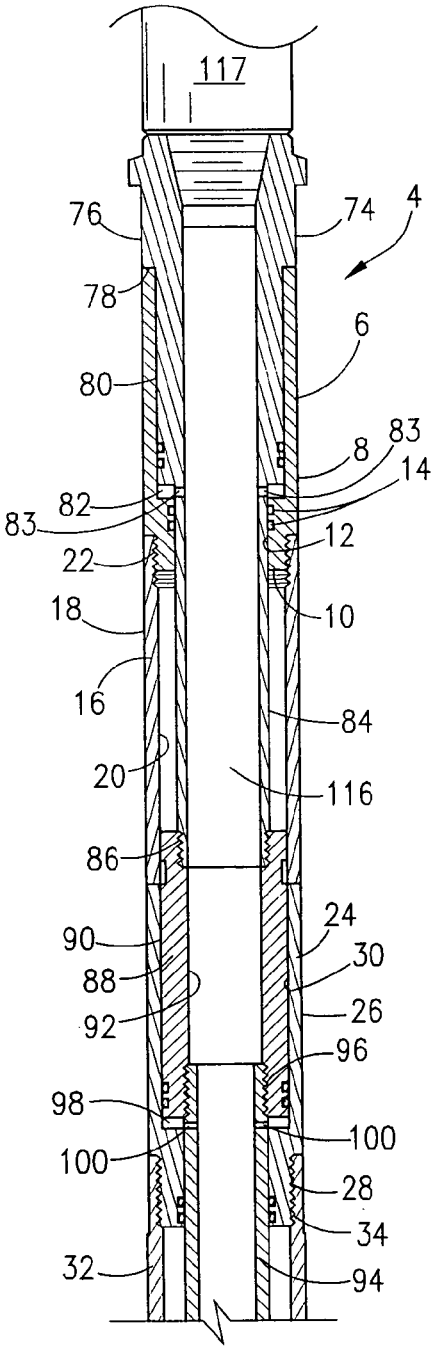
FIGS. 1A and 1B are a partial cross-sections depicting the device and setting tool in the contracted state.
Figure 1B:
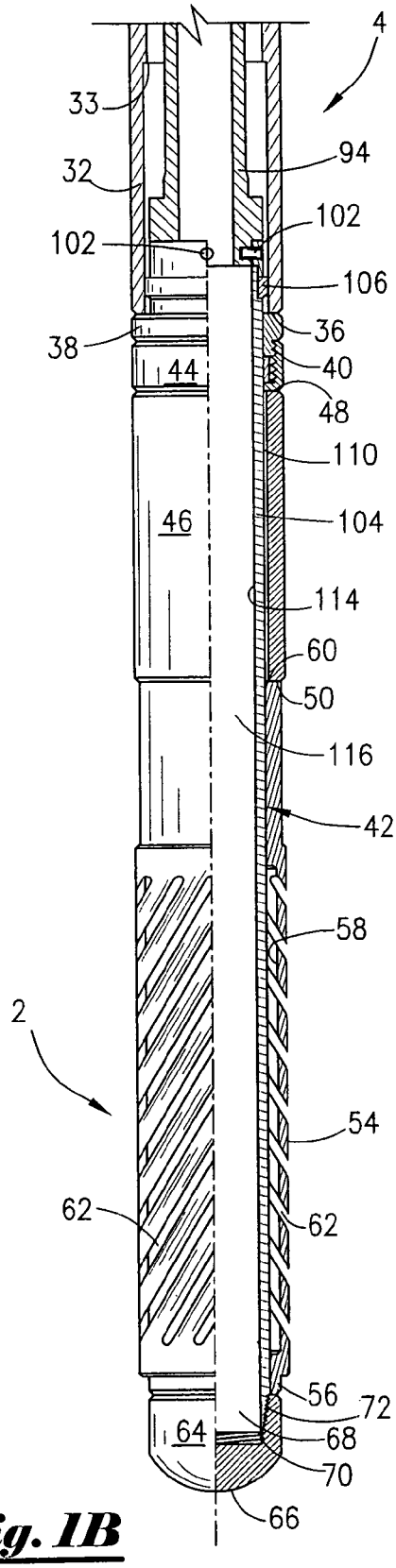

Referring now to FIGS. 1A and 1B, a partial cross-section depicting the spiral device 2 and associated setting tool 4 in the contracted state will now be described. This contracted state would be the way that the device 2 is lowered into the well bore on a work string such as coiled tubing, drill pipe, production string, etc. Other types of work strings are possible such as wireline, braided line, etc. The setting tool 4 shown in this embodiment is a hydraulic force type of setting tool. It should be noted that other types of setting tools may be employed such as mechanical means and explosive means.

In the preferred embodiment depicted in FIGS. 1A and 1B, and with first reference to FIG. 1A, the setting tool 4 consist of a series of housings including first housing 6 that has a first outer cylindrical surface 8 that extends to an annular shoulder 10 which in turn extends to an inner surface 12 containing a pair of o-rings 14. The first housing 6 is threadedly connected to second housing 16, with the second housing 16 having an outer cylindrical surface 18 and an inner surface 20, with the inner surface 20 having threads 22 for threadedly connecting to the first housing 6.

The second housing 16 abuts the third housing 24, with the third housing 24 having an outer cylindrical surface 26 that extends to a reduced surface that contains outer threads means 28, which in turn extends to the inner surface 30. The setting sleeve 32 contains a shoulder 33 thread means 34 that will connect with thread means 28. As seen in FIG. 1B, the end 36 of setting sleeve 32 will abut the lock ring retainer 38. The lock ring retainer 38 contains thread means 40 on the internal portion so that the lock ring retainer 38 will be connected to the collar 44, which is also referred to as a lock ring housing.

The collar 44 abuts the lock ring retainer 38. Positioned next to the collar 44 is the spacer sleeve 46, with the spacer sleeve 46 being a generally cylindrical member having a first end 48 and a second end 50. The first end 48 abuts the collar 44 and the second end abuts the spiral device 2. The spiral device 2 is generally a cylindrical member that has an outer diameter surface 54 that extends to the end 56 which in turn extends to the inner diameter surface 58 which in turn extends to the second end 60, wherein the second end 60 abuts the second end 50 of the spacer sleeve 46.

As seen in FIG. 1B, the spiral device 2 contains a pattern of spiral cut slots about the outer diameter surface. In one embodiment, the spiral cut slots extends through the wall of the spiral device 2. The angle of the slots contributes to maximum expansion ability and in order to completely cover the annular area where the spiral device is set. If the angle is too high (60 degrees), the assembly is weakened and opens in multiple places to smaller maximums. If the angle is too low (20 degrees), it may be too difficult to open or creates a shape that has contact points at the casing inner diameter rather than completely contacting along the entire circumference of the casing inner diameter. Cuts made in a 25–45 degree angle performed best in providing total perimeter contact. In the manufacturing of the spiral device 2, a laser cutting manufacturing technique is used to create the cleanest and narrowest cut possible. In the preferred embodiment, the cut is ⅛ inches wide or less. This leaves more material to achieve additional slot cuts on the same initial tool diameter. Additional slots give greater mechanical coverage of the annular area. Therefore, once expanded, there are no open areas within the annulus area.

The actual spiral cut is, for example, denoted by the numeral 62. The end 56 will abut a bull plug 64. The bull plug 64 has a closed end 66 and an open end 68, and wherein the open end contains internal thread means 70. As shown, the internal thread means 70 will threadedly mate with the external thread means 72 of the fourth mandrel sub 104.

FIG. 1A also depicts the power mandrel 74 that contains a first outer cylindrical surface 76 that extends to a shoulder 78 and in turn extends to the second outer cylindrical surface 80. As shown in FIG. 1A, the power mandrel 74 is disposed within the top housing 6. A chamber 82 is formed between top housing 6 and power mandrel 74. The power mandrel contains a pair of ports 83 for communication into the chamber 82. The outer diameter surface 80 extends to the outer diameter surface 84, with the outer diameter surface 84 containing the thread means 86 for threadedly mating with the intermediate power mandrel 88. The intermediate power mandrel 88 has an outer surface 90 disposed within the third housing 24. The outer surface 90 extends radially inward to the inner surface 92. The lower mandrel 94 is threadedly mated with the intermediate power mandrel 88 via thread means 96, and wherein a chamber 98 is formed with the third housing 24 and intermediate power mandrel 88. Also, a pair of ports 100 is provided within the lower mandrel 94 and in communication with the chamber 98.

As seen in FIG. 1B, the lower mandrel 94 is pinned 102 to the fourth mandrel sub 104. The fourth mandrel 104 contains a stroke limit ring means 106 that is disposed within a recess in the fourth mandrel sub 104. The fourth mandrel sub 104 has an outer diameter surface 110 that extends to the external threads 72 that will cooperate with the threads 70 of the bull plug 64. Extending radially inward will be the inner diameter surface 114. The bore 116 runs through the entire length of the tool and terminates at the bull plug 64.

FIG. 1A also depicts where the setting tool 4 is connected to a work string 117. As noted earlier, the work string is generally a tubular member such as coiled tubing, drill pipe, snubbing pipe, productions string, etc. The work string 117 can be used for delivering the upward and/or downward force, convey slurries, providing the conduit for delivery of hydraulic pressure, etc, all as is readily understood by those of ordinary skill in the art. The upward force and the downward force are relative terms in relation to the figures of the application, and therefore, when the upward force is used it means a force in a first direction and downward force means a force in a basically opposing direction. Additionally, please note that the other work strings are possible. For instance, a wireline, electric line or braided line could be used with a power device setting tool, such as an explosive setting tool. This explosive setting tool takes the place of the hydraulic setting means, and will be described later in the application.

Figure 2A:
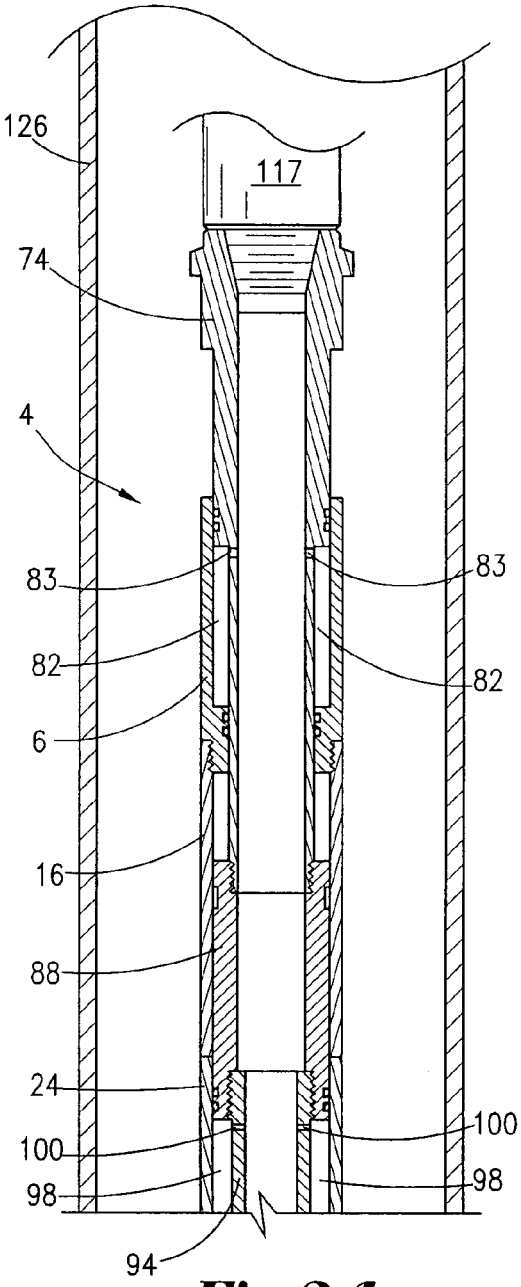
FIGS. 2A and 2B are partial cross-sections of the device illustrated in FIGS. 1A and 1B, with the tool being in an expanded state.
Figure 2B:
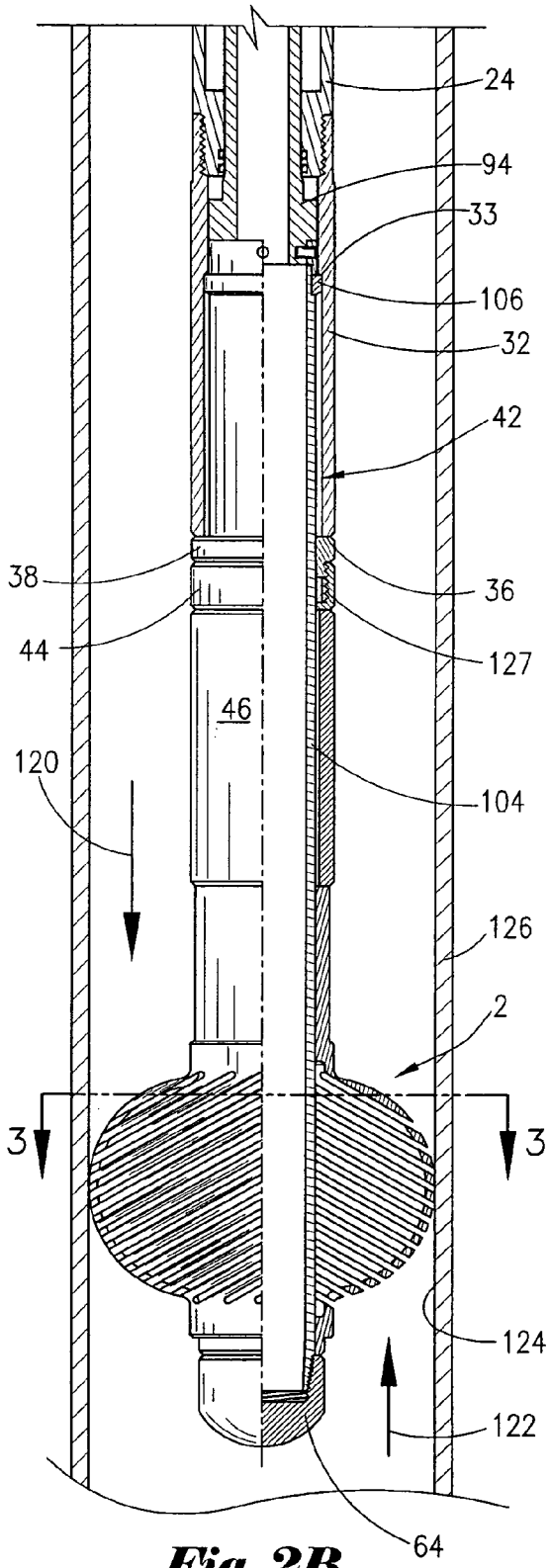

Referring now to FIGS. 2A and 2B, a partial cross-section of the device illustrated in FIGS. 1A and 1B, with the tool being in an expanded state via the setting tool 4 will now be described. It should be noted that like numbers appearing in the various figures refer to like components. Thus, the operator would apply a hydraulic pressure within the work string, with the work string being a tubular such as coiled tubing, drill pipe, production string, snubbing pipe, etc. As seen in FIG. 2A, the hydraulic pressure will enter the ports 83 thereby expanding the chamber 82. Also, the hydraulic pressure will enter the ports 100 so that the chamber 98 expands.

Due to the applied hydraulic pressure, as the chamber 82 expands and the chamber 98 expands, the outer housing will be forced in a downward relative movement. More particularly, the first housing 6 which is connected to the second housing 16 forces the third housing 24 which in turn forces the setting sleeve 32 in the same downward movement. The end 36 of the setting sleeve 32 acts against the lock ring retainer 38 which in turn acts against the spacer sleeve 46 and in turn acts against the spiral device 2. The downward force is denoted by the arrow 120.

Additionally, and at essentially the same time, as the chamber 82 expands and the chamber 98 expands, the power mandrel 74, along with connected intermediate power mandrel 88, lower mandrel 94 and mandrel 42 will have a generally upward force applied thereto. As shown in FIG. 2B, the mandrel 42 is threadedly connected to the bull plug 64, and therefore, this upward force is transferred to the bull plug 64. The upward force is denoted by the arrow 122: As noted earlier, the upward force and downward force are relative to the spiral device 2 shown in the figures; however, in the case where the spiral device 2 is used in deviated and/or horizontal wells, the upward force relates to a first force and the downward force would relate to an opposing force.

Therefore, the upward force (first force) 122 and the downward force (opposing force) 120 act to compress the spiral device 2. The spiral device 2, due to its novel construction, will expand to and abut the internal wall 124 of the casing 126. When the term casing is used, it is to be understood to include tubulars, pipes, liners, well bores and flowlines.

As seen in FIG. 2B, the upper stroke limit of the setting tool 4 is limited by the stroke limit ring means 106 coming into contact with the shoulder 33 of the setting sleeve 32 thereby preventing further movement of the mandrel and housing. This limits the amount of compression of the spiral device 2.

As will be described later in the application, the spiral device 2 can contain an outer layer which may be an elastomeric member. Thus, as the spiral device 2 is expanded, the elastomeric member will form a seal with the wall 124 of the casing 126. Additionally, there may be provided a ratchet means for incrementally advancing the setting sleeve 32 relative to the mandrel 104 while preventing backward retraction of the spiral device and spacer sleeve 46, with the ratchet means being denoted by the numeral 127 and is contained on the collar 44.

Figure 3:
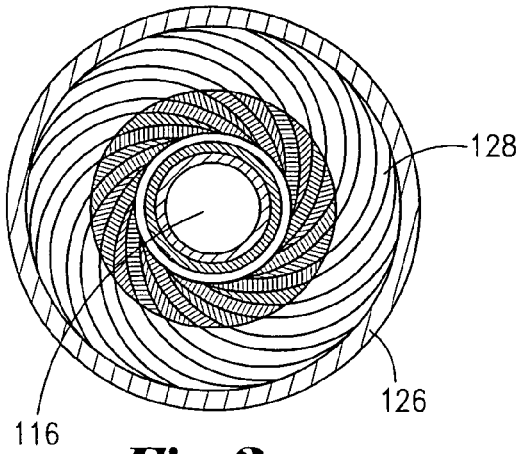
FIG. 3 is a cross-section of the expanded device taken from the line A—A of FIG. 2.

In FIG. 3, a cross-section of the spiral device 2 taken from the line 3—3 of FIG. 2B will now be described. Thus, the individual bands of the spiral device 2 have expanded outward, as seen in FIG. 3, so that the spiral device 2 is anchored within the casing 126. An exemplary individual band is shown as 128. The individual bands will expand outward along the spiral cut. As per the teachings of this invention, the bands completely close-off the annular area. In other words, in the preferred embodiment there is complete coverage by the bands within the annular area. FIG. 3 also depicts the bore 116. Thus, after the spiral device 2 has been set, the bore 116 remains open. In cases where the bull plug 64 is not used, or alternatively, is removable by some means, the bore 116 can used to flow and/or pump through the entire spiral device 2.

Figure 4A:
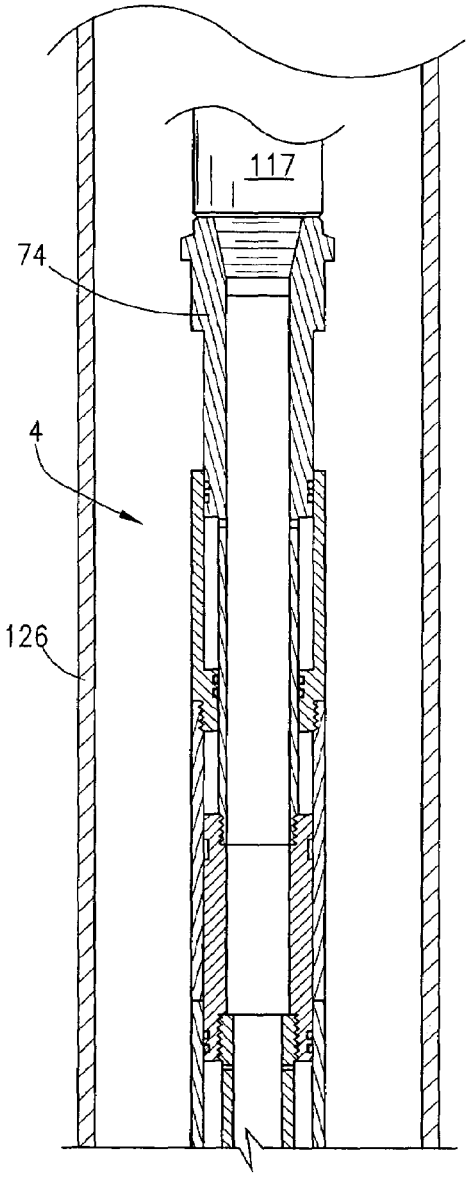
FIGS. 4A and 4B are partial cross-sections after being sheared off, with the spiral tool left in the well bore.
Figure 4B:
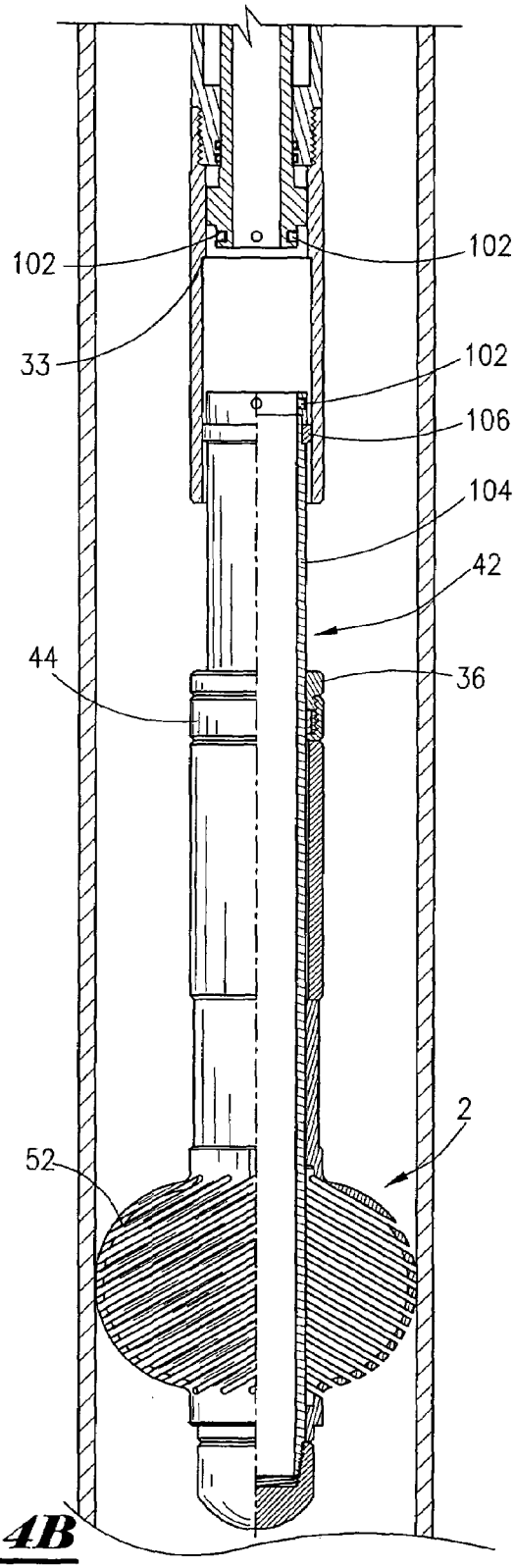

Referring now to FIGS. 4A and 4B, a partial cross-section of the spiral device 2 shown after being sheared off will now be described. As shown in FIG. 4B, the spiral device 2 has been anchored in the casing 126. In the preferred embodiment, and now referring to FIG. 4A, this is performed by providing hydraulic force which in turn produces an upward force on the work string 117. More specifically, the operator will cause a hydraulic pressure down the work string 117 to provide the necessary force, wherein the force is transferred to the power mandrel 74 which in turn is transferred to the stroke limit ring means 106. The stroke limit ring 106 abuts the shoulder 33 during this process. The continued upward force applied will be transferred to pins 102 from mandrel 74, and ultimately, pins 102 will shear (as seen in FIG. 4B), due to the continued application of hydraulic pressure after the stroke limit ring 106 abuts shoulder 33. As noted earlier, the stroke limit ring 106 prevents further compression of spiral device 2, therefore, the only movement is of power mandrel 74 in an upward direction. Once the shear pins 102 are sheared, the operator can continue to exert a pulling force on the work string 117 thereby removing the power mandrel 74 from the casing 126. As seen in FIG. 4B, the remainder of the spiral device 2 remains in the casing 126.

Figure 5:
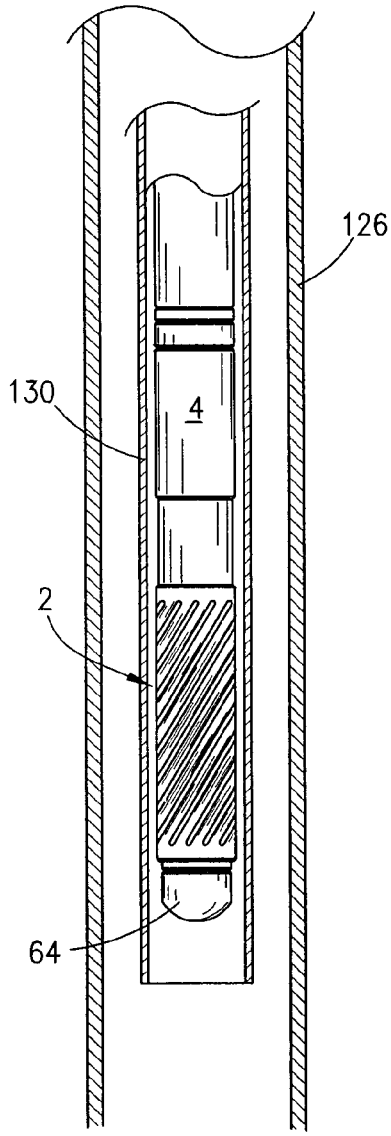
FIG. 5 is a schematic illustration of the device being lowered into a tubular string within a well.
Figure 6:
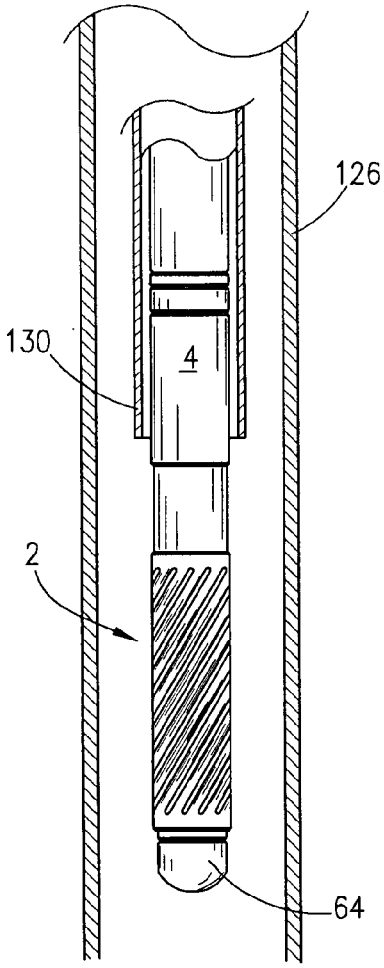
FIG. 6 is a schematic illustration of the device shown in FIG. 5 after being lowered through the tubular string and out into the well.
Figure 7:
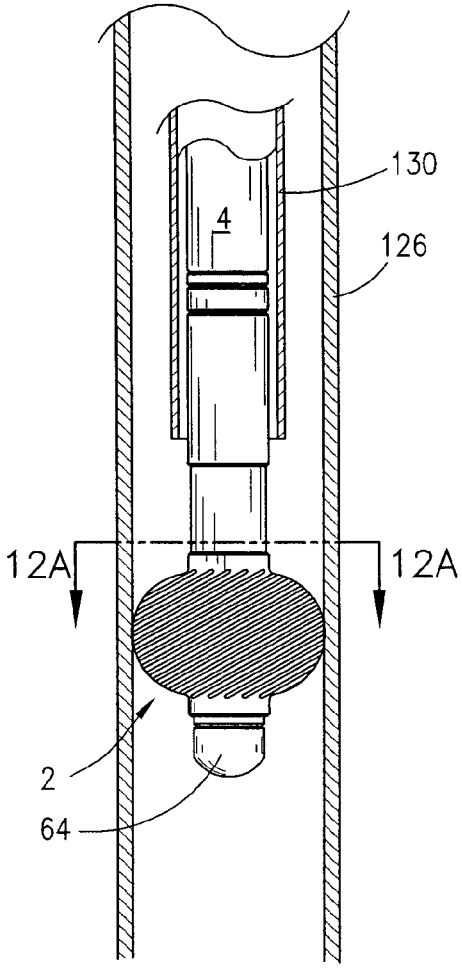
FIG. 7 is a schematic illustration of the device seen in FIG. 6 after having been expanded within the well.

FIGS. 5, 6 and 7 show a process of running into a well bore and setting the spiral device. More specifically, FIG. 5 is a schematic illustration of the device 2 being lowered through a tubular string 130, with the tubular string 130 being placed concentrically within the casing 126. The outer diameter portion of the spiral device 2 must be less than the inner diameter portion of the tubular string 130, as is readily understood by those of ordinary skill in the art. Many times, however, once the spiral device 2 exits the tubular string 130, the operator will want to expand the spiral device in order to anchor and/or seal off in a larger inner diameter environment, such as the casing 126. Hence, FIG. 6 depicts a schematic illustration of the spiral device 2 shown in FIG. 5 after being lowered through the tubular string 130 and out into the casing 126. FIG. 7 is a schematic illustration of the device seen in FIG. 6 after having been expanded within the casing 126. Thus, as seen in FIG. 7, the spiral device 2 has been expanded, as previously described. The spiral device 2 is anchored and/or sealed within the casing 126.

Figure 8:
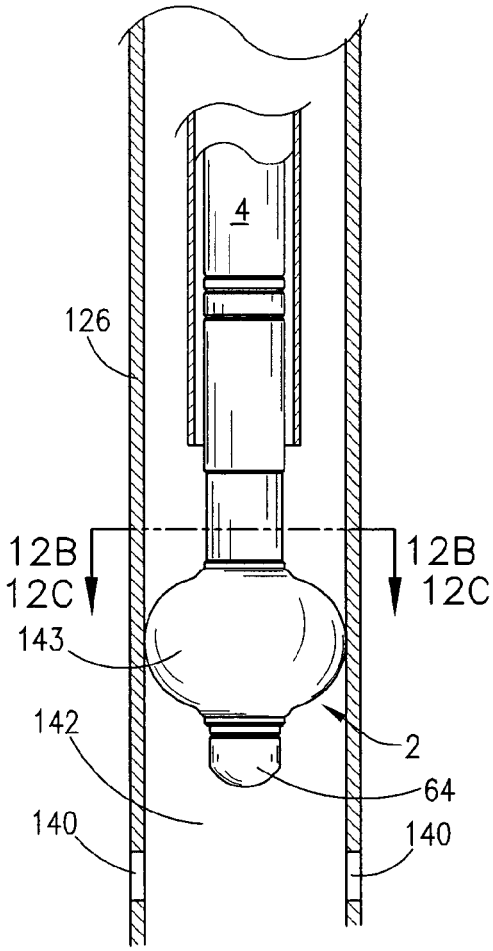
FIG. 8 is a schematic illustration of the device being used in conjunction with production operations.

Many applications of the present invention exist. For instance, in FIG. 8, a schematic illustration of the device being used in conjunction with production operations, and more specifically, with terminating production, will now be described. In FIG. 8, the spiral device 2 has been expanded to anchor and seal-off within the casing 126. The perforations 140 communicate a subterranean reservoir to the annulus 142 for ultimate production to the surface. In the embodiment of FIG. 8, the hydrocarbons that enter into the annulus 142 will be precluded from being produced through the bore of the spiral device 2 to the surface due to the plug 64, as is readily understood by those of ordinary skill in the art. Further, FIG. 8 shows the elastomeric member 143 that encapsulates the outer surface of the spiral device 2. As the individual bands of the spiral device 2 expand, the elastomeric member 143 will also expand and sealingly engage with the inner diameter portion of the casing 126. A slurry, such as cement, can also be dumped on the top of the spiral device 2.

Figure 9A:
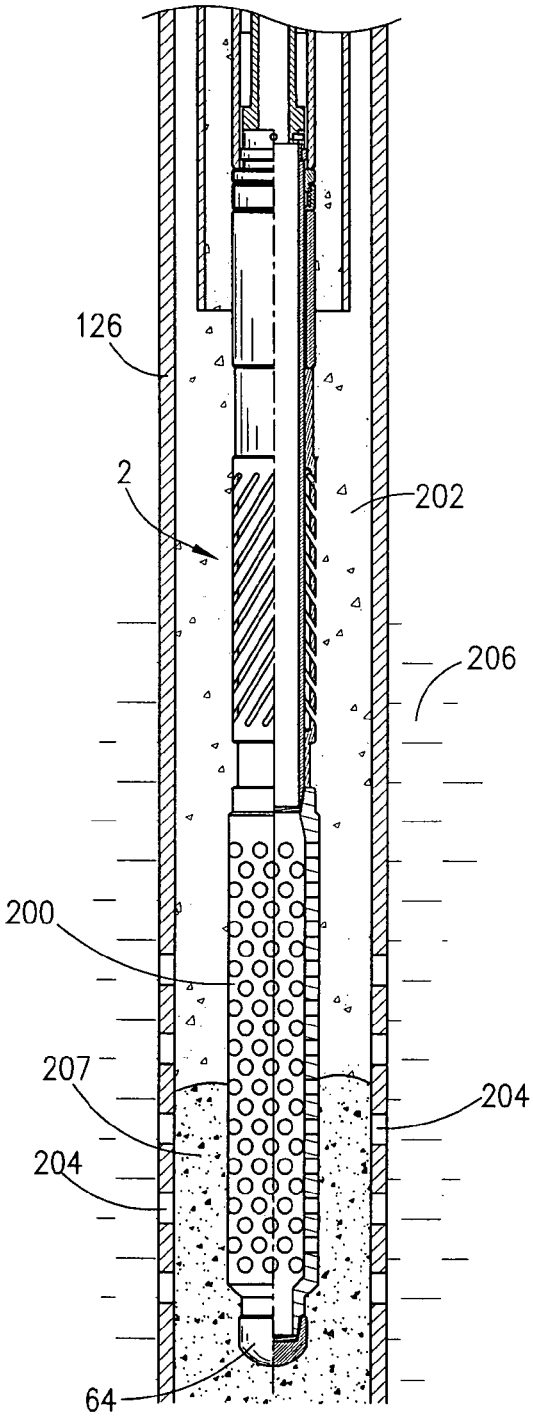
FIG. 9A is a schematic illustration of the device being used in conjunction with gravel packing a well bore completed to a subterranean reservoir.

Referring now to FIG. 9A, one of the preferred embodiments of the spiral device 2 used in gravel packing a well completed to a subterranean reservoir will now be described. Thus, the spiral device 2 will have attached thereto a gravel pack screen 200 that will be connected to the spiral device 2 via conventional means such as thread means. Gravel pack screens are commercially available from Weatherford Inc. under the name gravel pack screens.

The spiral device 2 will be lowered via conventional means, such as coiled tubing, tubular strings, production strings, etc, as previously described. Once the spiral device 2 is lowered to the desired position within the well, a gravel pack slurry can be placed into the well as shown in FIG. 9A. The gravel pack slurry generally comprises sand particles suspended within a carrying fluid as is readily understood by those of ordinary skill in the art. The sand particles are shown being placed within the annulus and about the gravel pack screen 200. The sand particles are schematically denoted by the numeral 202. The well 126, which is generally a casing string, will have perforations 204 to communicate the subterranean reservoir 206 with annulus 207 and the gravel pack screen 200.

Figure 9B:
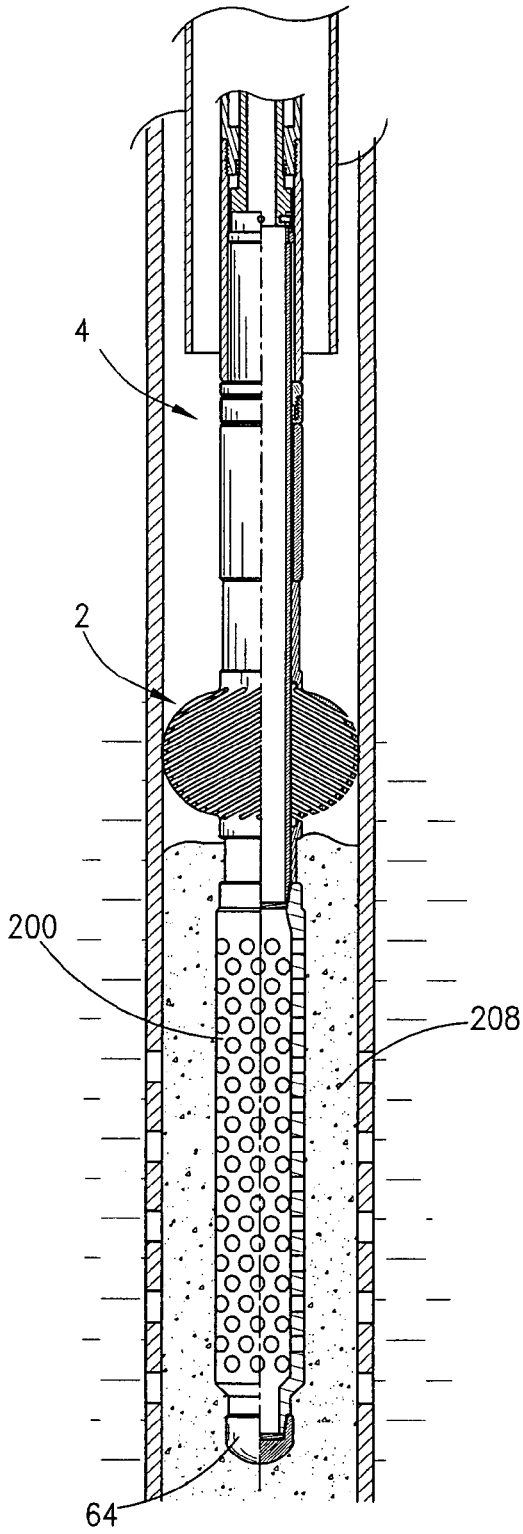
FIG. 9B is a sequential view of the device of FIG. 9A with the spiral tool having been set within the well.
Figure 9C:
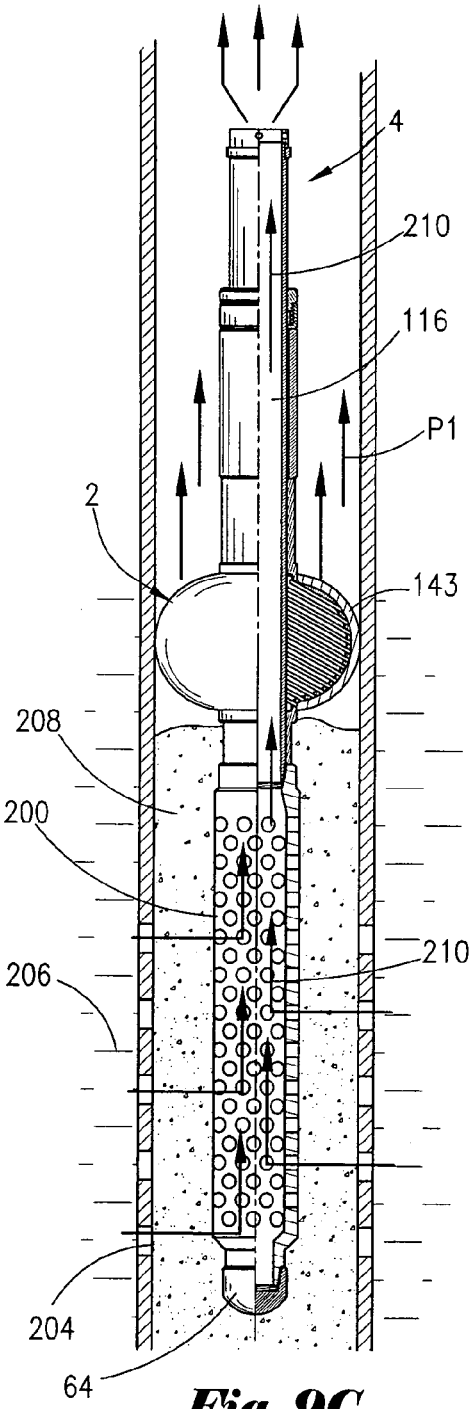
FIG. 9C is a sequential view of the device of FIGS. 9A and 9B with production occurring from the subterranean reservoir.

Once the gravel pack sand has been pumped and in place, the spiral tool 2 can be set within the well as shown in FIG. 9B. The setting of the spiral tool 2 takes place as previously discussed utilizing the setting tool 4. The gravel pack about the screen 200 is denoted by the numeral 208. In FIG. 9C, a sequential view of the spiral device 2 is depicted with production occurring from the subterranean reservoir 206. Hence, production flow will be through the perforations 204, through the gravel pack 208, up through the spiral device 2 and up to the surface, as denoted by the arrows denoted by the numeral 210. It should be noted that a permeable elastomeric cover 143 is shown. Hence, production flows through the permeable cover 143 to the surface (as denoted by the arrows P1) as well as through the bore 116 (denoted by the arrows 210).

However, it is also possible to have an impermable cover. In the case of an impermeable cover, production can only occur by entering the bore 116; in other words, production is precluded from entering the annulus due to the impermeable cover and flows only through the bore 116 (arrows 210).

Figure 9D:
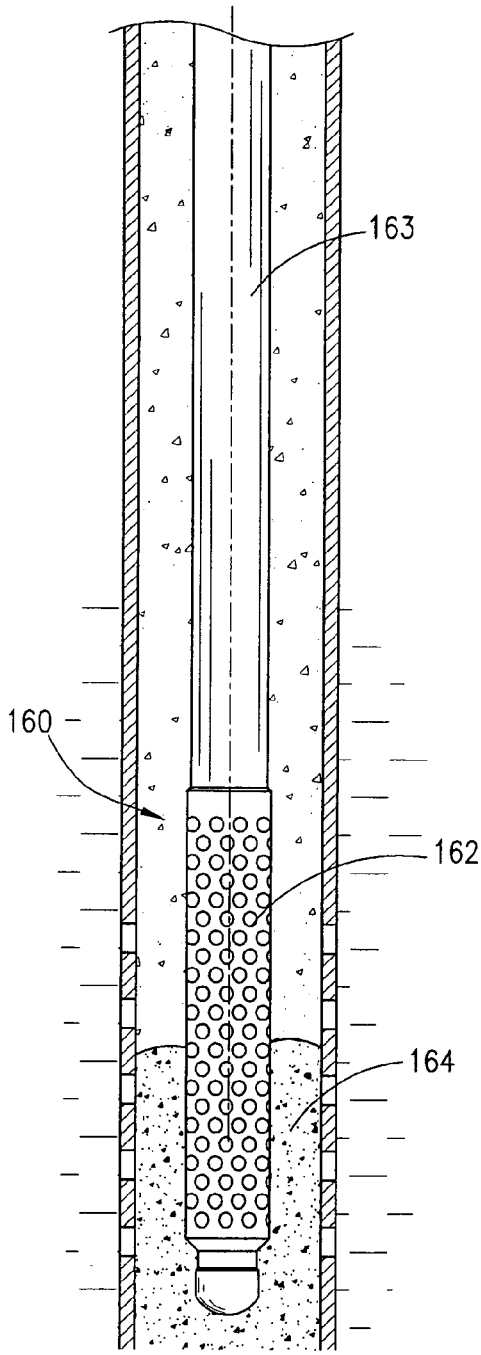
FIG. 9D is a schematic illustration of another embodiment being used in conjunction with gravel packing a well bore completed to a subterranean reservoir.
Figure 9E:
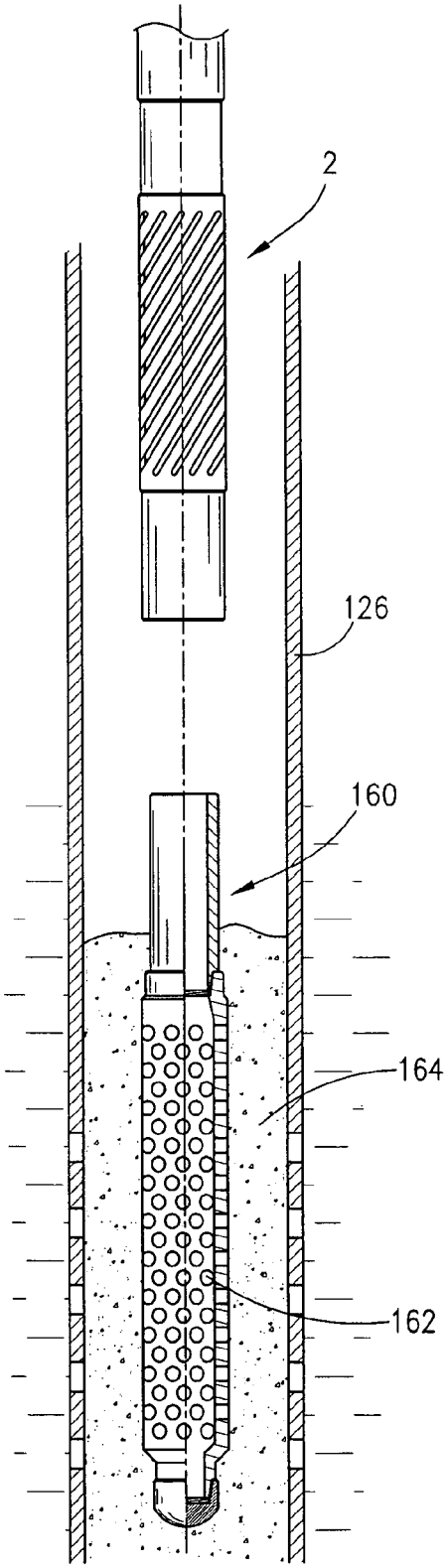
FIG. 9E is a sequential view of the embodiment seen in FIG. 9D showing the device being landed into the top of the gravel pack assembly.
Figure 9F:
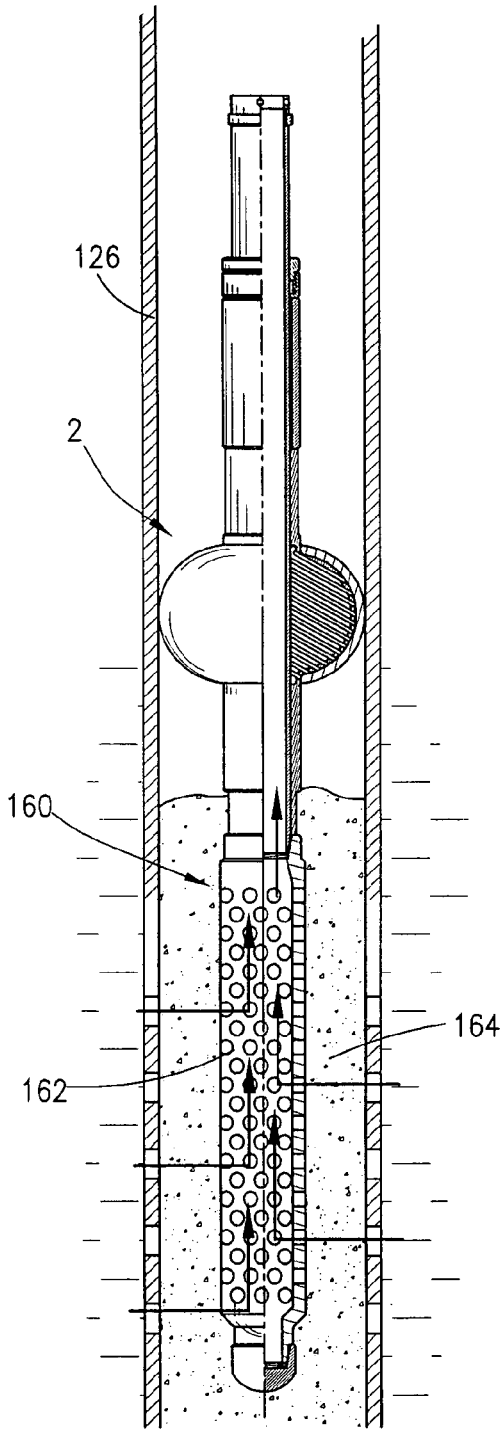
FIG. 9F is a sequential view of the embodiment seen in FIG. 9E showing the device being set and ready for production.

Additionally, as seen in FIG. 9D, this invention also teaches an additional embodiment that includes running into the well with a gravel pack assembly 160 that includes a gravel pack screen 162 run in on a work string 163. The gravel pack screen 162 is lowered and set at the desired location in the well thereby forming an annulus. A gravel pack slurry (seen generally as numeral 164) is placed about the gravel pack screen 162. Next, and as seen in FIG. 9E, a spiral tool 2 is run into the well and wherein a distal end of the spiral tool 2 is latched onto the top of gravel pack assembly 160 The spiral tool 2 can then be set within the well as previously described. FIG. 9D shows the spiral tool 2 latched into the top of the gravel pack assembly 160, and the tool 2 set. The well can then be produced through the gravel pack 164 and gravel pack screen 162, as readily understood by those of ordinary skill in the art.

Figure 10A:
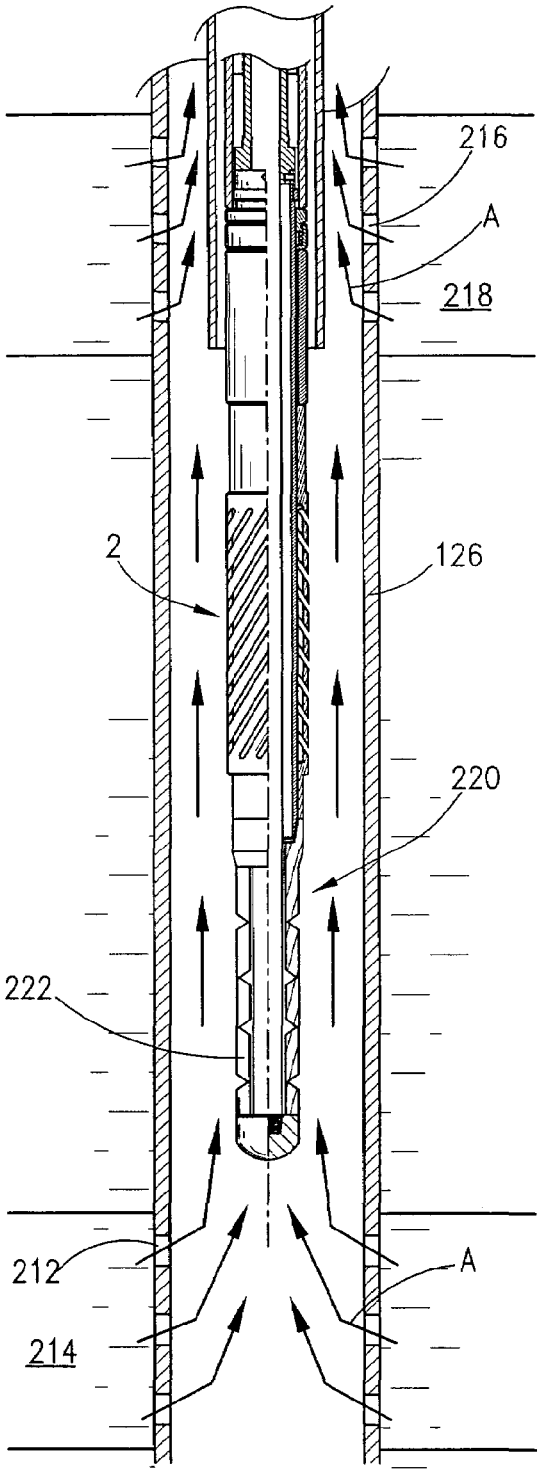
FIG. 10A is a schematic illustration of the device being run into position within a well, with the device to be used as a bridge plug.
Figure 10B:
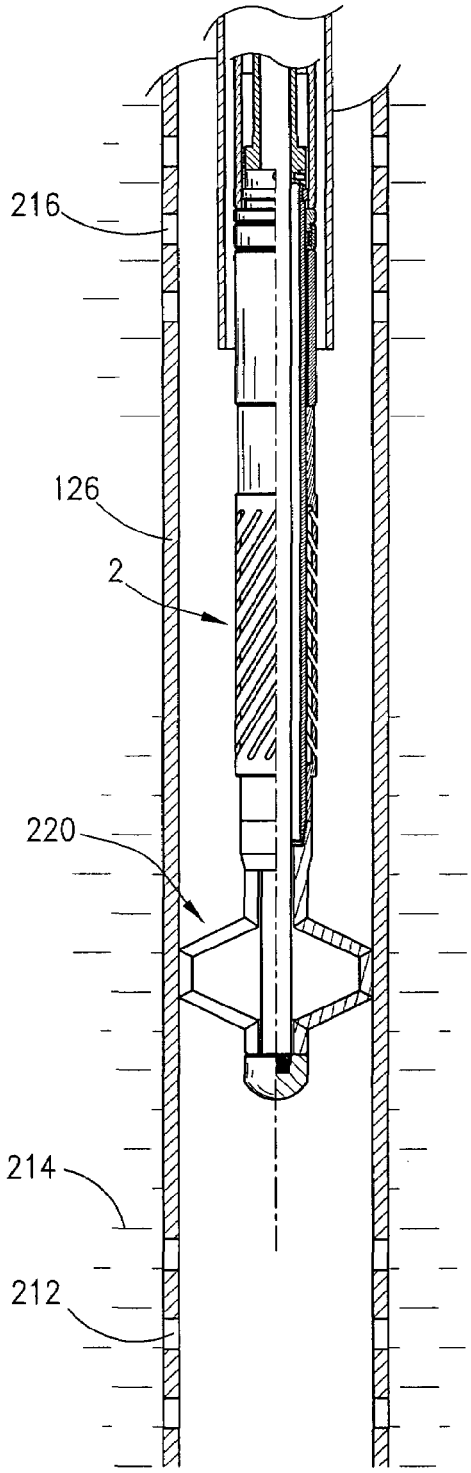
FIG. 10B is a sequential view of the device of FIG. 10A with the anchor apparatus having been set within the well.

Referring now to FIG. 10A, a schematic illustration of the device positioned within a well 126, with the spiral device 2 being used as a bridge plug. In the embodiment of FIGS. 10A–10B, the spiral device 2 may sometimes referred to as the second anchor apparatus. The well 126 has two sets of perforations, lower set 212 that communicate with the subterranean reservoir 214 and the upper set 216 that communicate with the subterranean reservoir 218. The spiral device 2 will have attached thereto the first anchor apparatus 220. The first anchor apparatus 220 has arms, seen generally at 222, for expansion to engage the walls of the casing 126. The production flow from the reservoir 214 is shown by the arrows A. It should be noted that a more detailed view of a bridge plug with two anchors will be described later in the application.

The setting force for the first anchor 220 is isolated from the device 2 to allow for sequential setting of the anchor and device 2. In some applications, the continued application of on the spiral device would cause damage to the spiral device. Excessive compression of the plug may cause the elastomer coating to be damaged losing the hydraulic sealing ability. The setting apparatus sets the anchor first and then the anchor is isolated from the setting apparatus to prevent additional force from damaging the anchor while the plug is set.

In FIG. 10B, a sequential view of the spiral device 2 seen in FIG. 10A is shown with the first anchor apparatus 220 having been set within the well 126. The spiral device 2 and anchoring apparatus 220 is positioned between the perforations 216 and 212. There exist many reasons why an operator would want to set a bridge plug within a well. One example is that the lower reservoir 214 is producing water, and the operator wishes to terminate the water production. Therefore, a bridge plug is placed in order to cease production from the lower zone (214).

Figure 10C:
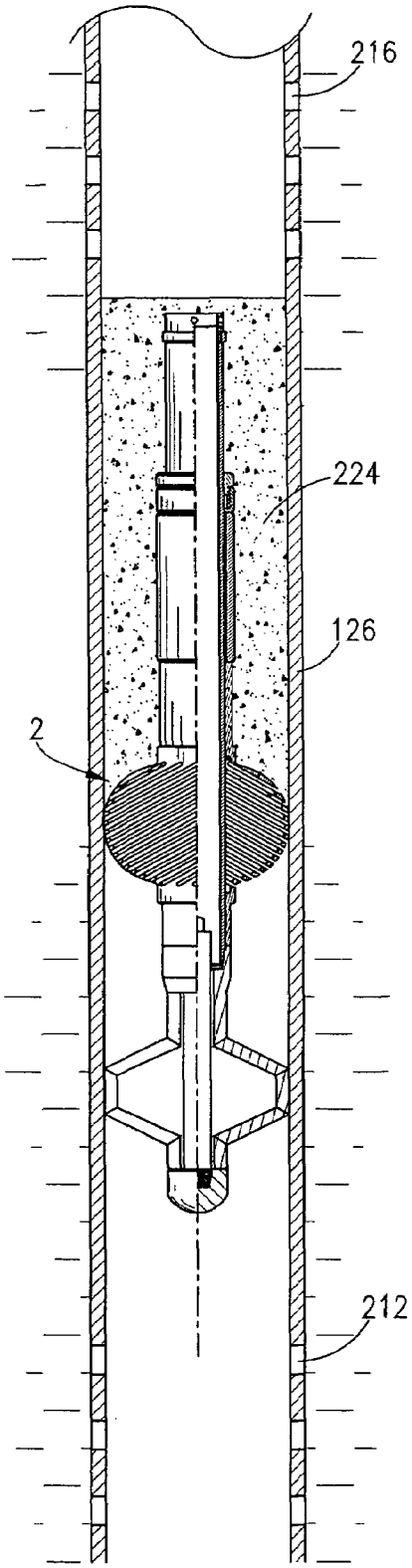
FIG. 10C is a sequential view of the device of FIG. 10B with the device having been set within the well.

FIG. 10C is a sequential view of the device of FIG. 10B with the spiral device 2 having been set within the well 126. Hence, the spiral device 2 is set as previously described. FIG. 10C also shows a cement on top of the plug 224. The cement plug 224 is normally dump bailed via wireline and will rest on top of the spiral device 2. The cement plug 224 can also be pumped from the surface. The cement is allowed to solidify thereby forming a permanent, impermeable plug and ensures that the plug does not move and forms a seal from the bottom zones.

Figure 11:
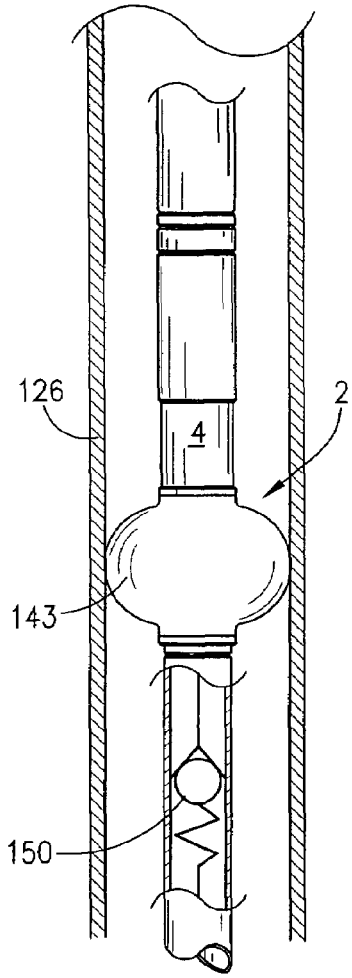
FIG. 11 is a schematic illustration of the device being used as a thru-tubing retainer.

FIG. 11 is a schematic illustration of the spiral device 2 being used as a thru-tubing retainer. In this embodiment, a one-way check valve means 150 has been added. Thus, flow from below and through the spiral device 2, and up to the surface would not be allowed, however, flow from above the spiral device 2 to below the spiral device 2 would be allowed. The elastomeric cover 143 is also shown.

Figure 12A:
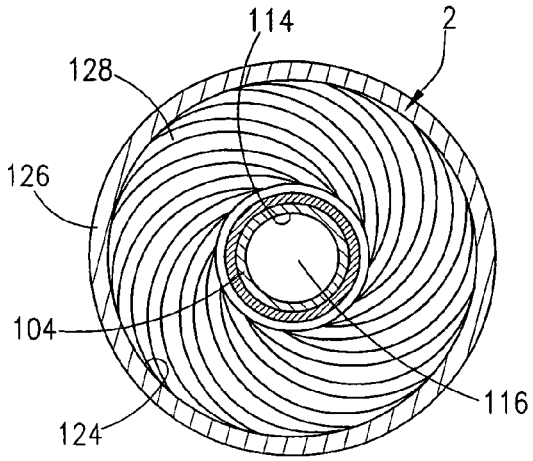
FIG. 12A is a cross-section taken from line 12A—12A of FIG. 7 showing the expandable device's metal slats.

Referring now to FIG. 12A, a cross-section taken from line 12A—12A of FIG. 7 will now be described. FIG. 12A depicts the expandable device 2, and in particular the expansion of the device 2 causes individual metal slats to radially extend outward, and wherein a single metal slat is denoted by the numeral 128. As shown, the metal slats extend from the mandrel sub 104 and will engage the inner wall 124 of casing 126. Note that in the preferred embodiment, ans as shown in FIG. 12A, the annular area is completely closed-off.

Figure 12B:
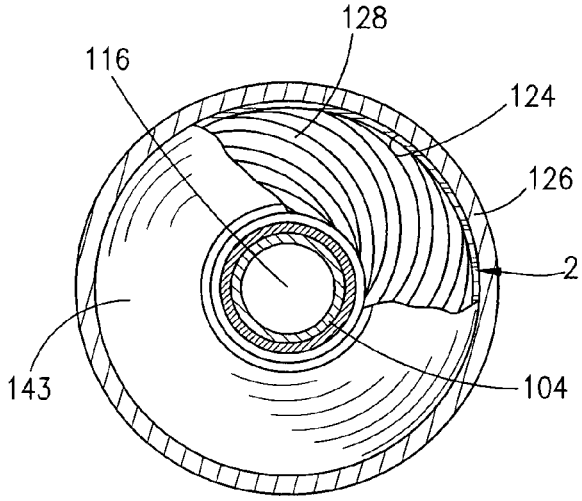
FIG. 12B is a cross-section taken from line 12B—12B of FIG. 8 showing the expandable device and a partial elastomeric means.

In FIG. 12B, a cross-section taken from line 12B—12B of FIG. 8 showing the expandable device 2 and a partial elastomeric means 143 covering the expandable device 2. This partial view illustrates how the elastomeric means 143 covers the metal slats. Thus, FIG. 12B depicts the expandable device 2 being covered by the elastomeric means 143, and wherein the elastomeric means 143 will be forced against the wall 124 of casing 126 thereby providing a hydraulic seal. As previously noted, the elastomeric means 143 can be a rubber sheet material.

Figure 12C:
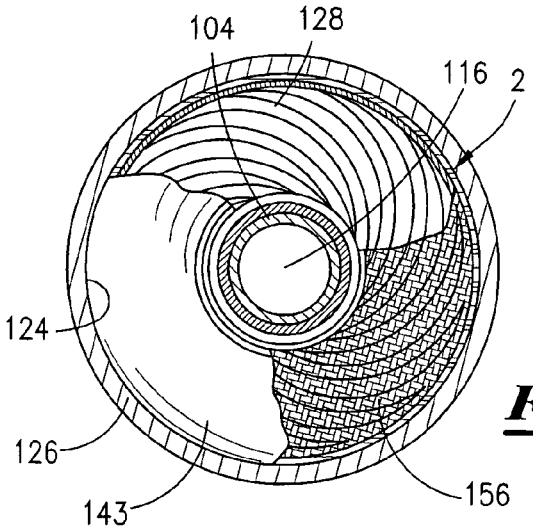
FIG. 12C is a cross-section taken from line 12C—12C of FIG. 8 showing the expandable device and a partial elastomeric means and a partial mesh means.

In yet another embodiment, FIG. 12C illustrates a cross-section taken from line 12C—12C of FIG. 8 showing the expandable device 2 along with a partial elastomeric means 143 and a partial mesh means 156. This partial view is illustrated to depict how the elastomeric means 143 covers the mesh means 156. Thus, in the embodiment of FIG. 12C, the mesh means 156 will be the first layer covering the metal slats, and then the second layer will be the elastomeric means 143. In this embodiment, the mesh means 156 strengthens the elastomer to hold a differential pressure applied across the plug since the ribs expand, and the ribs structurally supports the rubber circumferentially. Also, there is less chance to cut the elastomeric means 143 when the expandable device 2 expands. It should be noted that elastomeric means 143 may be permeable or impermeable.

Figure 13:
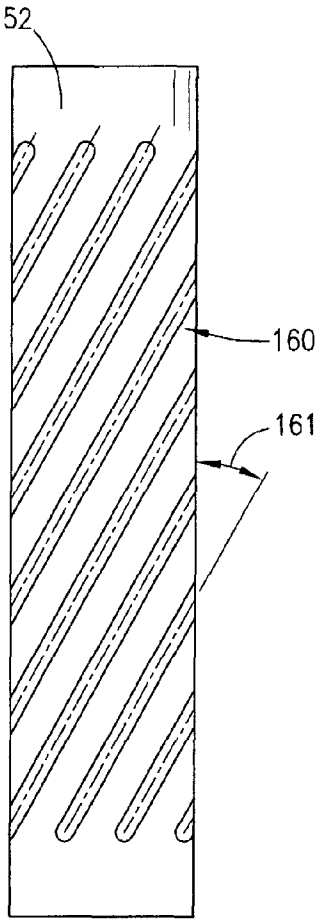
FIG. 13 is a side view of a first embodiment of the slot pattern of the present invention.

Referring now to FIG. 13, a side view of a first embodiment of the slot pattern of the present invention will now be described. This embodiment shows the slot pattern as being slanted at a constant angle of inclination for all slots, with the cuts of the individual slots running generally parrallel to each other in a same direction. The slot pattern in FIG. 13 is referred to as a spiral pattern and is denoted by the numeral 160. In one of the preferred embodiments, the angle of inclination of the slots shown in FIG. 13 is approximately 37 degrees, which is shown by the numeral 161. It is to be understood that the angles can vary from 20 degrees to 50 degrees, with a preferred range from 25 degrees to 45 degrees. The angle is offset from the longitudinal center of axis of the outer tubular member.

Figure 14:
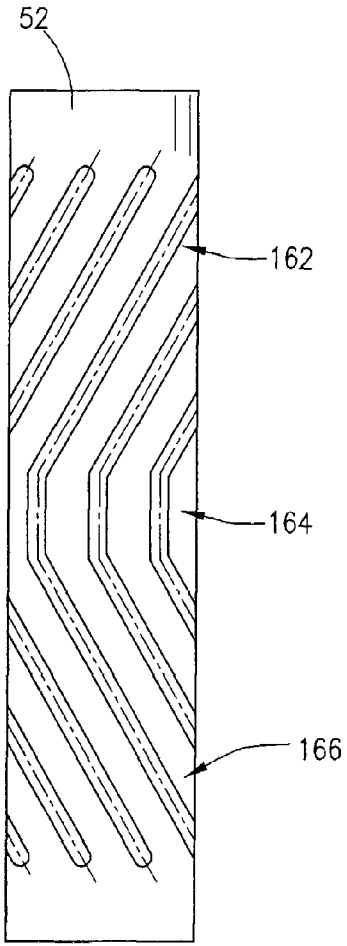
FIG. 14 is a side view of a second embodiment of the slot pattern of the present invention.

In FIG. 14, a side view of a second embodiment of the slot pattern of the present invention is illustrated. This embodiment depicts a first spiral pattern running in a first direction (denoted by the numeral 162), which in turn extends to a cut parallel to the longitudinal axis of the device 2 (denoted by the numeral 164) which in turn extends to the second spiral pattern which is essentially the opposite direction of the first slot pattern 162. This second spiral pattern is denoted by the numeral 166. In one preferred embodiment, the angle of the first spiral pattern 162 is approximately 37 degrees, even though the angles can vary from 20 degrees to 50 degrees, with the preferred range from 25 degrees to 45 degrees, and the angle of the second spiral pattern 166 is 37 degrees, even though the angles can vary from 20 degrees to 50 degrees, with the preferred range from 25 degrees to 45 degrees.

Figure 15:
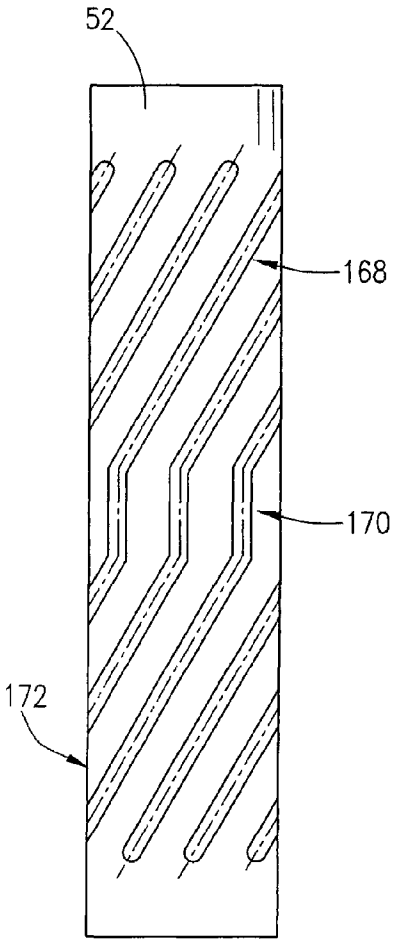
FIG. 15 is a side view of a third embodiment of the slot pattern of the present invention.

Referring to FIG. 15, a side view of a third embodiment of the slot pattern of the present invention will now be described. In this embodiment, the slot pattern has a first spiral pattern running in a first direction (denoted by the numeral 168), which in turn extends to a slot parallel to the longitudinal axis of device 2 (denoted by the numeral 170) which in turn extends to the second spiral pattern which is essentially the same direction of the first spiral pattern 168. This second spiral pattern is denoted by the numeral 172. As in the embodiment of FIG. 13 and FIG. 14, the angle of the first spiral pattern 168 and second spiral pattern 172 is approximately 37 degrees, even though the angles can vary from 20 degrees to 50 degrees, with the preferred range being 25 to 45 degrees. It is to be understood that the slot patterns may be changed depending on the specific circumstances of the well, the restrictions, the down hole conditions, the objective of the operation, etc. Thus, while three slot patterns have been shown, many other patterns are possible with the teachings of this invention.

Figure 16A:
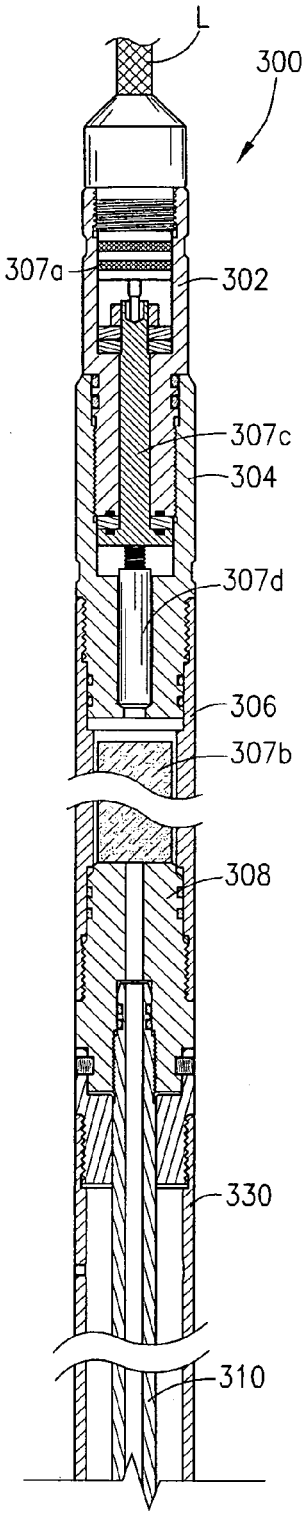
FIGS. 16A–16E are cross-sectional views of a preferred embodiment of the electric line set bridge plug device with setting apparatus.

Referring now to FIGS. 16A–16E, a most preferred embodiment of the bridge plug device 300 will now be described. The bridge plug device 300 of FIGS. 16A–16E is the most preferred embodiment of the bridge plug device, wherein another embodiment was seen in FIGS. 10A–10C. As seen in FIG. 16A, the bridge plug device 300 is attached to a wireline, which in the preferred embodment is an electric line L. The device 300 contains a first sub 302 that is threadedly connected to a second sub 304 which in turn is connected to third sub 306. The sub 302 has an explosive charge setting apparatus 307*a*, and wherein the explosive charge setting apparatus 307*a* is set-off by a signal sent down the electric line L at the command of the operator. A circuit is completed by applying a current through the electric contact rod 307*c* which in turn sets off the blasting cap detonator 307*d*. The detonator 307*d* sets off the power charge. The power charge expands a gas within the chamber 307*b*, and as the power charge burns, the ensuing pressure exerts the necessary force needed to set the apparatus. The explosive charge setting apparatus is commercially available from Owen Oil Tools Inc. under the name Power Charge.

Figure 16B:
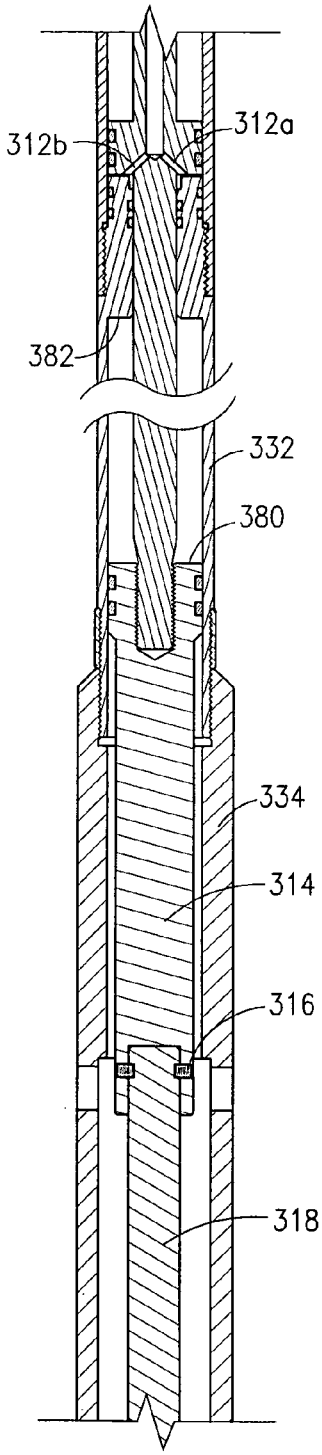
Figure 16C:
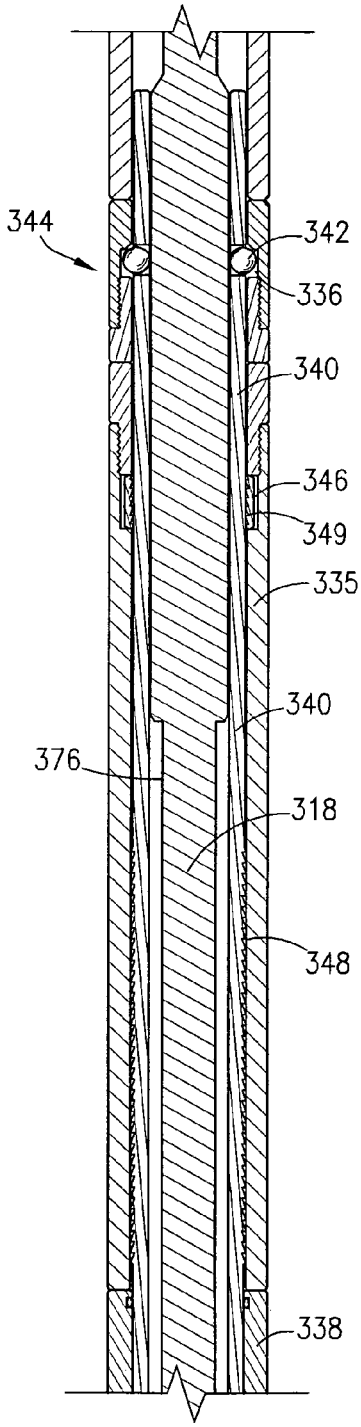

The third sub 306 is connected to the fourth sub 308, with the fourth sub 308 being connected to the first mandrel 310, and wherein the first mandrel 310 has the ports 312*a*, 312*b*, as seen in FIG. 16B. The first mandrel 310 will be connected to the second mandrel 314 which in turn is connected via shear pins 316 to the third mandrel 318 (shown in FIG. 16C). As seen in FIG. 16E, the third mandrel 318 is then threadedly connected to the tension bolt 320, and wherein the tension bolt 320 is threadedly connected to the fourth mandrel 322. The fourth mandrel 322 is connected to the fifth mandrel 324 which in turn is connected, via threads, to the tool mandrel 326. The tool mandrel 326 has the blind end 328 connected thereto.

Returning now to FIG. 16A, the first mandrel 310 is disposed within the first housing 330, and wherein the first housing extends to the second housing 332 which in turn extends to the third housing 334. The third housing 334 abuts the collar member, seen generally at 336 in FIG. 16C. The collar member 336 abuts the fourth housing 335. The fourth housing 335 abuts the fifth housing 338, wherein the fifth housing 338 contains the spiral cut slots, and as noted earlier, is sometimes referred to as the spiral device. The collar member 336 includes the latch means for latching the sleeve 340 to the fourth housing 335, and wherein the latch means contains ball detents 342 within an opening 344 in the sleeve 340. A ratchet means 346 is provided that includes the teeth projections seen as 348 on the sleeve 340 that cooperate with a pawl member 349 on the ratchet means 346. The ratchet means 346 allows movement of the sleeve 340 relative to housing 335 in a first direction, but prevents fourth housing 335 and fifth housing 338 from retracting thereby precluding unseating the spiral device.

Figure 16D:
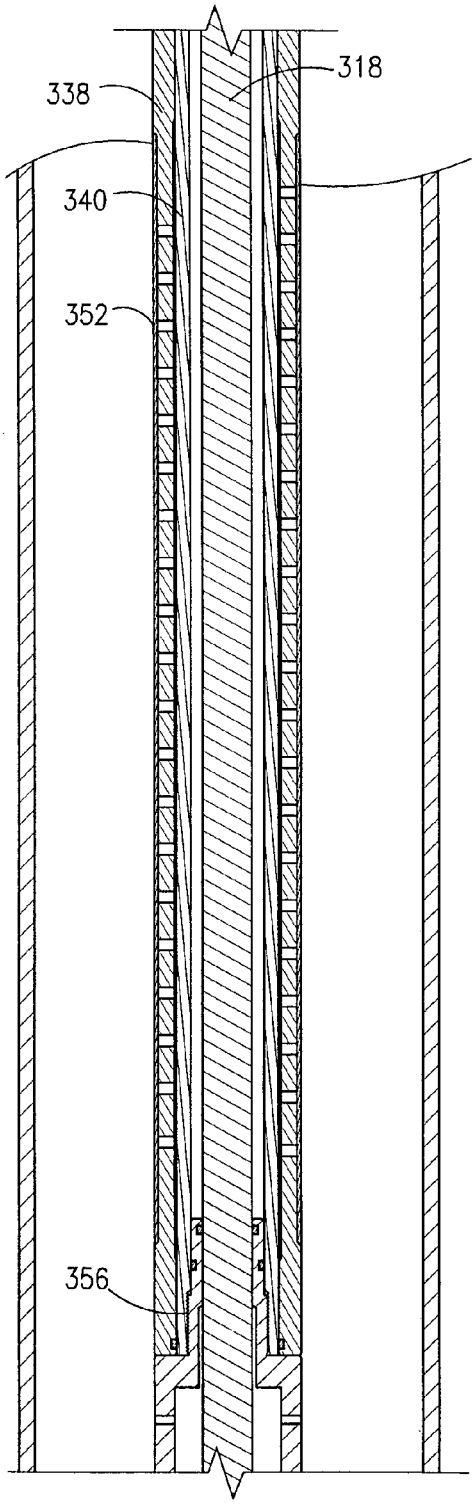
Figure 16E:
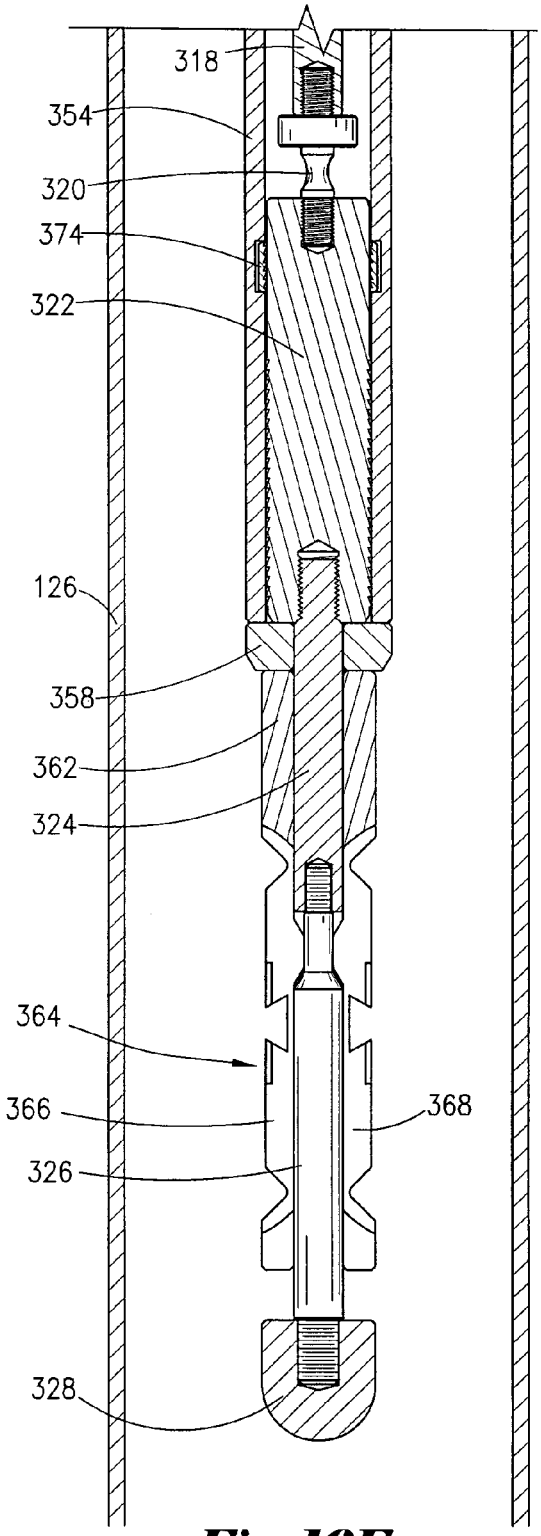

Referring now to FIG. 16D, the fifth housing 338 includes the spiral device previously described. In other words, a spiral slot pattern has been cut into the housing 338. Additionally, a cover 352, which may be an elastomer material, is disposed about the housing 338. The cover may be permeable or impermeable. The fifth housing 338 abuts the sixth housing 354, and wherein the sixth housing 354 is threadedly connected to the sleeve 340 at 356 seen in FIG. 16D. The sixth housing 354 abuts the collar 358 and wherein the collar 358 is disposed about the fifth mandrel 324. The sixth housing 362 abuts the pivoting arm anchor, generally seen at 364, and the pivoting arm anchor 364 contains a first arm 366 and second arm 368 that will pivot outward into engagement with the wall of the casing 126 that will be described later in the application.

Referring now to FIGS. 17A–17E, the sequence of setting the pivoting arm anchor 364 will now be described. It should be noted that the sequence illustrated in FIGS. 17A–17E and 18A–18E occur as a continuous reaction. In other words, once the force in the form of applied pressure is initiated, the complete setting of the anchor 364 and spiral tool 338 will transpire.

As noted earlier, and as seen in FIG. 17A, the operator will send a signal down the electric line L so that an explosive charge will be set-off which in turn will cause the gas to expand in chamber 307*b*. As seen in FIG. 17B through FIG. 17E, the application of pressure will enter ports 312*a*, 312*b* thereby expanding the chamber 370. By the application of the gas pressure acting on shoulder 372, the chamber 370 expands which in turn causes the outer housing to be forced down, including housings 330, 332, 334, 335, 338, 340, 342, 354, 358, 362. At the same time, the inner mandrel is subjected to an opposing force; however, the inner mandrel is held stationary. Hence mandrels 310, 314, 318, 322, 324, 326 will remain essentially stationary even though an upward force is being applied thereto. Referring now to FIG. 17E, the continued application of pressure will therefore cause the housing 362 to act downward against the pivoting arms 366, 368 so that the arms 366, 368 expand into engagement with the walls W of casing 126.

Figure 17A:
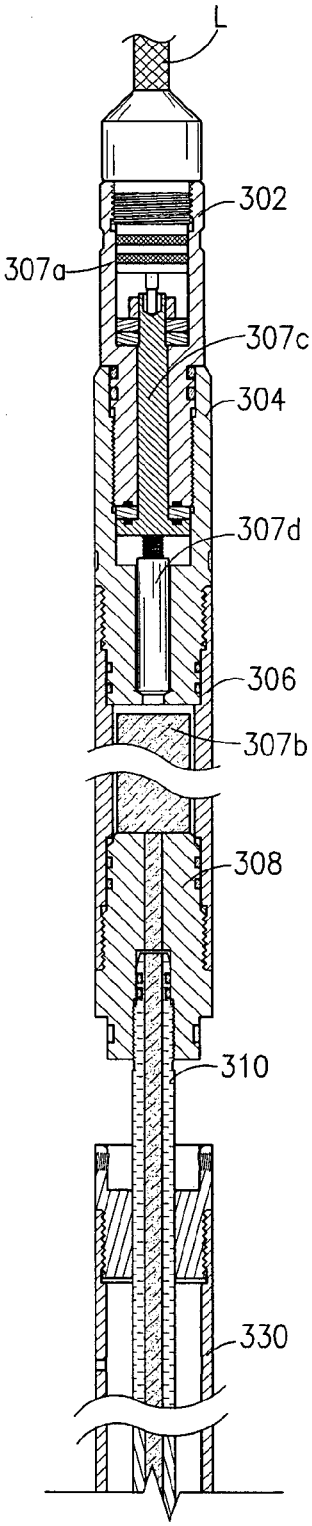
FIGS. 17A–17E are a sequential view of the bridge plug device seen in FIGS. 16A–16E showing the pivoting arm anchor set.
Figure 17B:
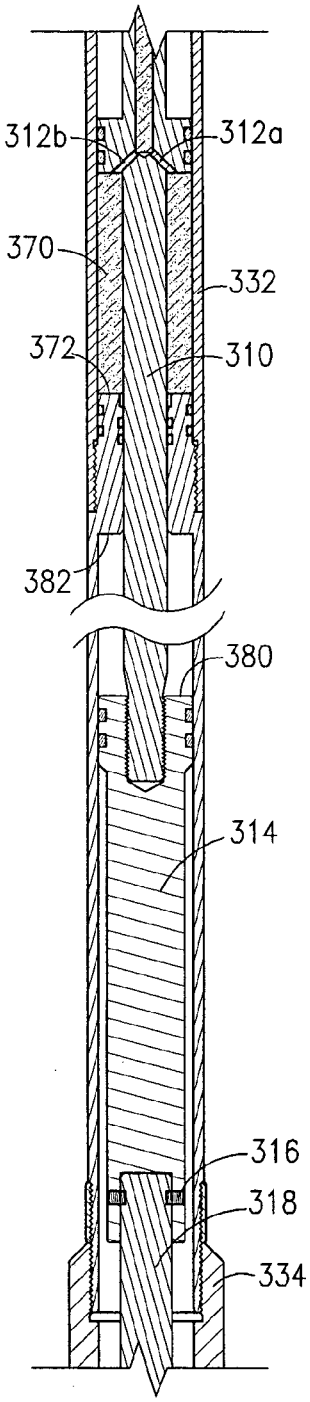
Figure 17C:
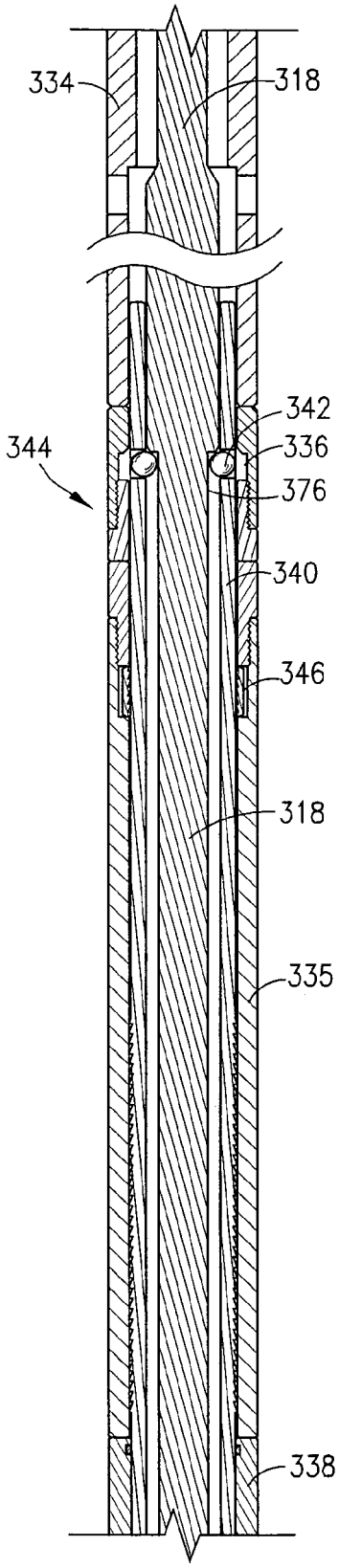
Figure 17D:
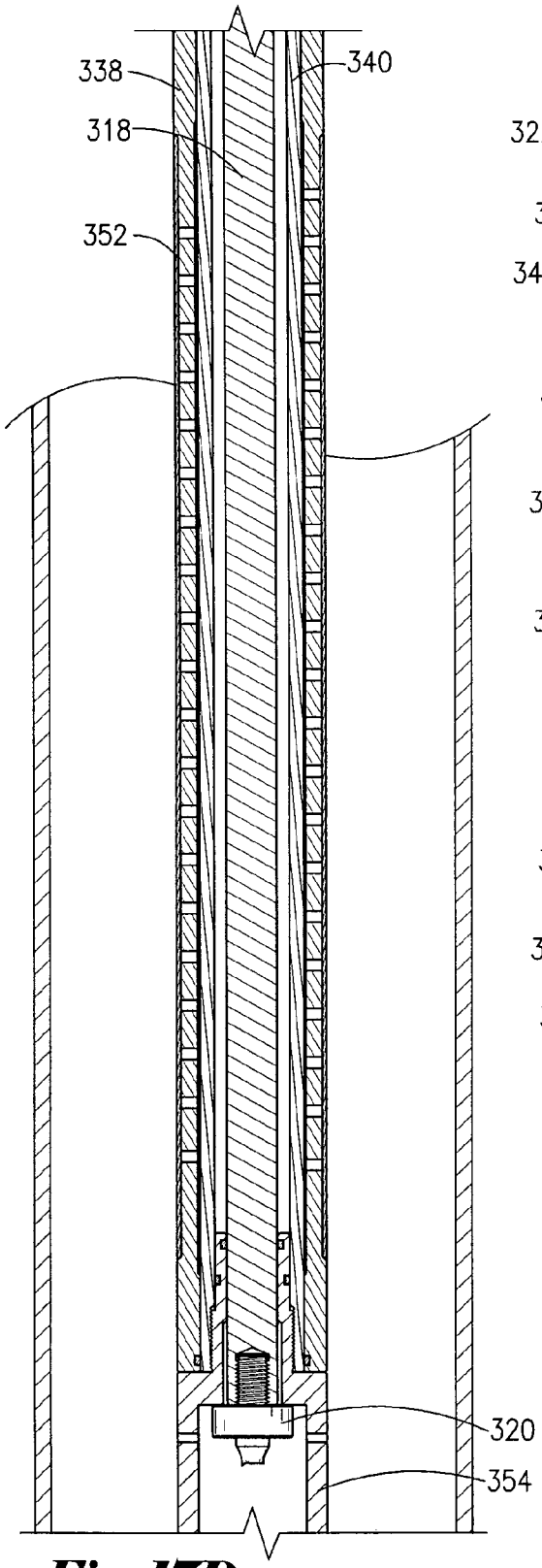
Figure 17E:
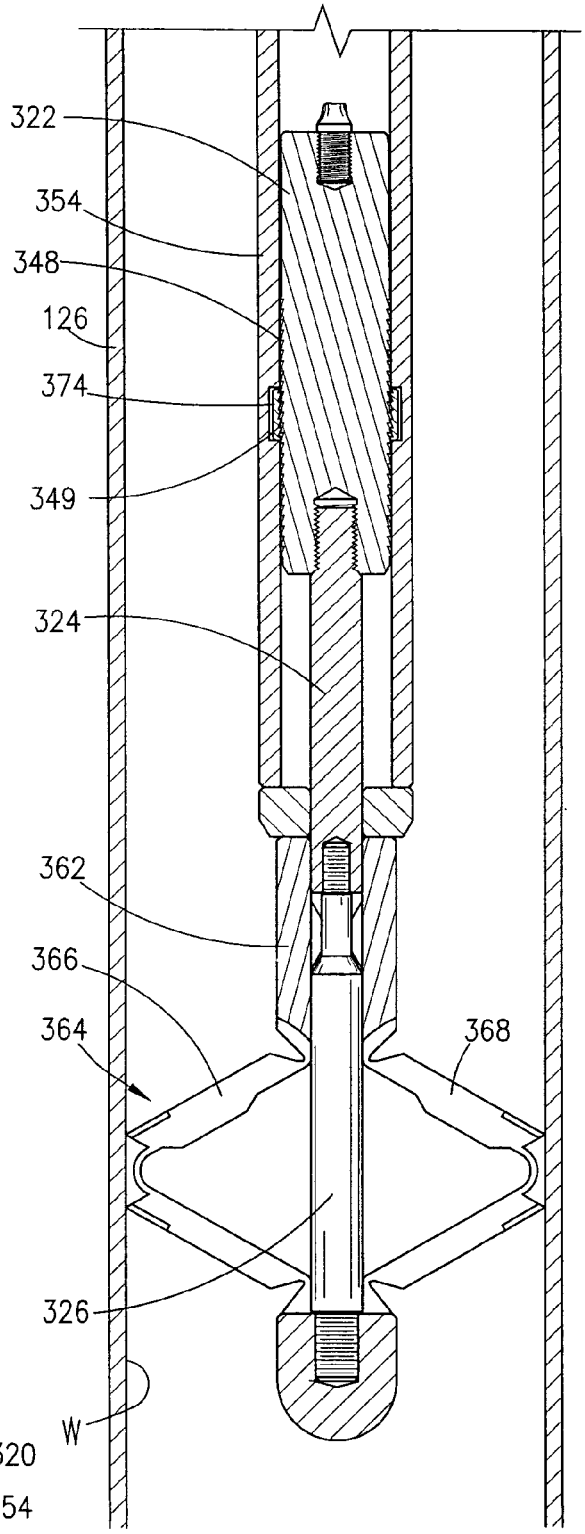

The application of said gas pressure will result in the shearing of tension bolt 320, as seen in FIGS. 17D and 17E, at a predetermined shear force. In other words, the tension bolt 320 shears due to the applied opposing forces. As seen in FIG. 17D, the ratchet means 374 will allow the movement of the outer housing in the downward direction, but will prevent movement in the upward direction, with the ratchet means 374 having a tooth 348 and pawl 349 design. Once the tension bolt 320 shears, the third mandrel 318 moves upward and in particular, the smaller diameter portion 376 interfaces with the ball detents 342 thereby allowing the ball detents 342 to drop out of the collar member 336. The ball detents 342 and collar member 336 had cooperated with the sleeve 340 so that the sleeve 340 and fifth housing 338 had acted as a single member and to prevent compression of fifth housing 338 until desired. However, once the ball detents 342 fall out, the sleeve 340 and fifth housing 338 separate and in effect become separate members.

Figure 18A:
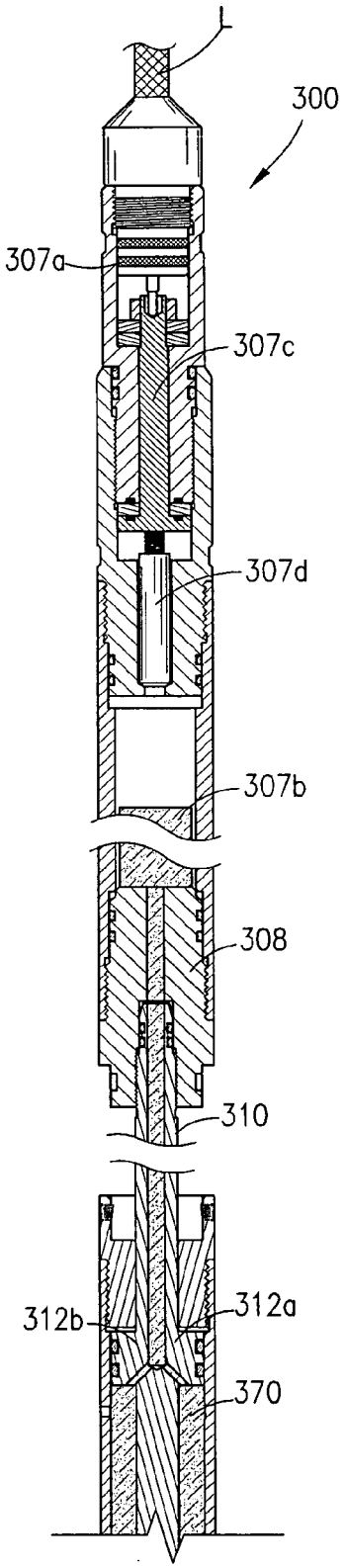
FIGS. 18A–18E are a sequential view of the bridge plug device seen in FIGS. 17A–17E showing the bridge plug device set within the well with the setting tool ready to be pulled from the well.
Figure 18B:
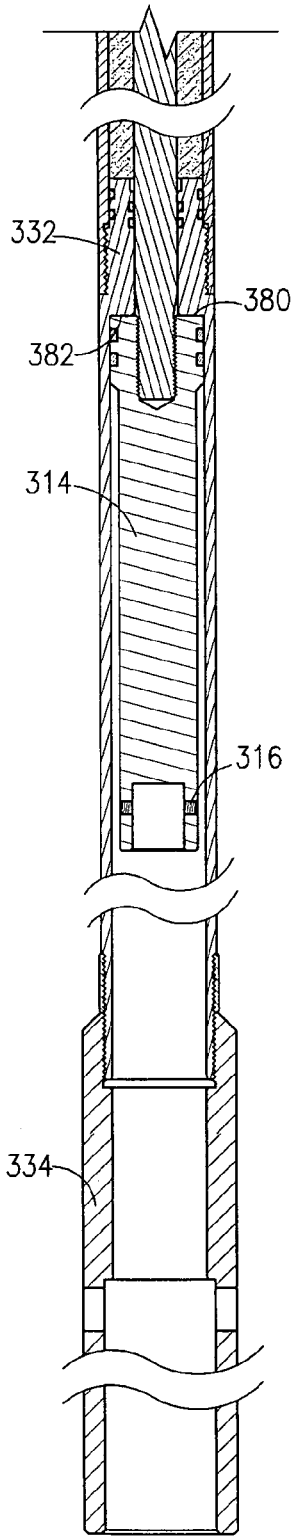
Figure 18C:
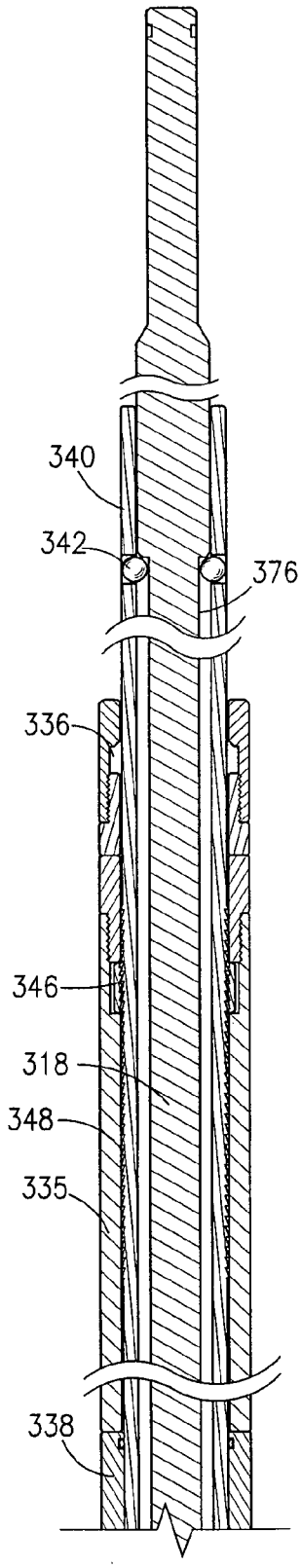
Figure 18D:
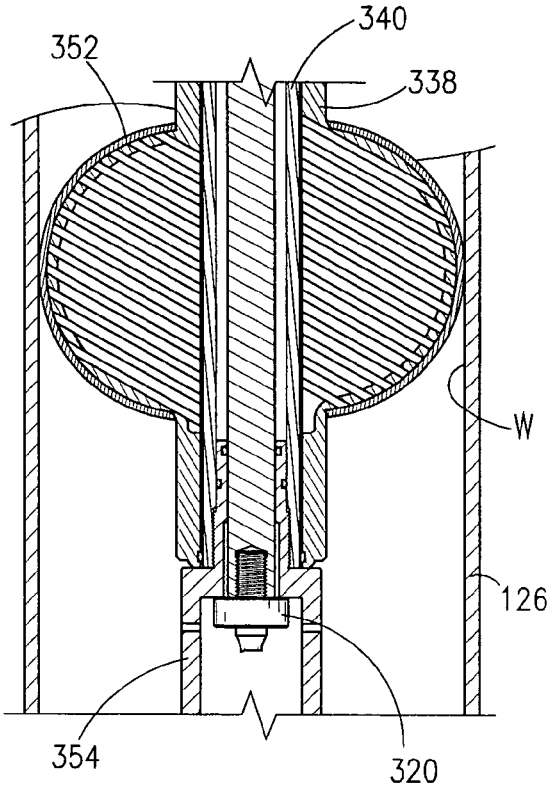
Figure 18E:
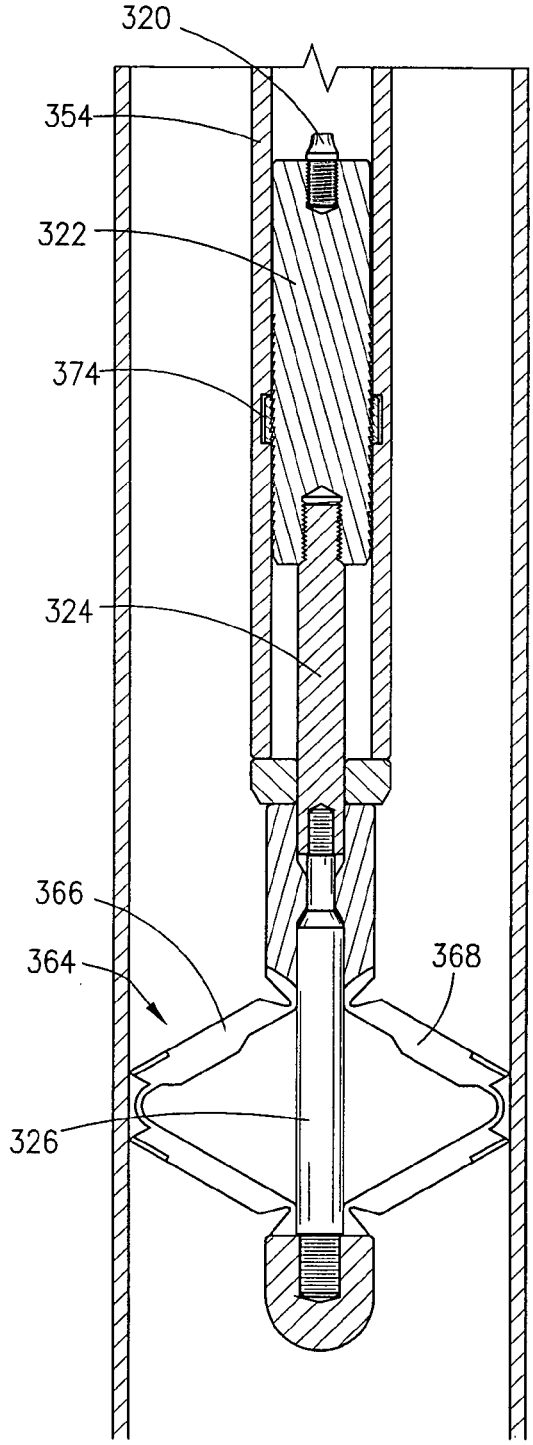

Referring now to FIGS. 18A–18E, the next sequential effect of the application of pressure is illustrated. Hence, since the sleeve 340 is no longer latched to the fifth housing 338, the fifth housing 338 will be forced downward thereby expanding the fifth housing 338 as seen in FIG. 18D. FIG. 18D depicts the fifth housing 338 having been forced downward thereby expanding by the applied downward force on the housings, and in particular, the fourth housing 335, as well as the opposing upward force on the inner mandrel 318 (also see FIG. 18C). As noted earlier, the fifth housing 338 contains the spiral slots, and therefore, upon expansion, the outer diameter of the fifth housing 338 expands to engage the wall W of the casing 126, and in particular, the cover 352 is shown engaging the wall W of the casing 126 in FIG. 18D.

The continued application of pressure will act to shear the shear pins 316, as seen in FIG. 18B. Also, the operator can exert an upward pull on the work string thereby aiding in the shearing of the shear pins 316. Once the shear pins 316 have sheared, the top shoulder 341 of sleeve 340 contacts the inside shoulder 335 of third housing 334 preventing overset of fifth housing 338, The shoulder 380 of the mandrel 314 will abut the shoulder 382 of the housing 332. The operator can then pull out of the casing 126 with the upper portion of the setting tool seen in FIGS. 18A, and 18B. The bridge plug device 300 is now set with two separate points of contact i.e. the arms 366/368 and the cover 352 of the spiral device.

Figure 19A:
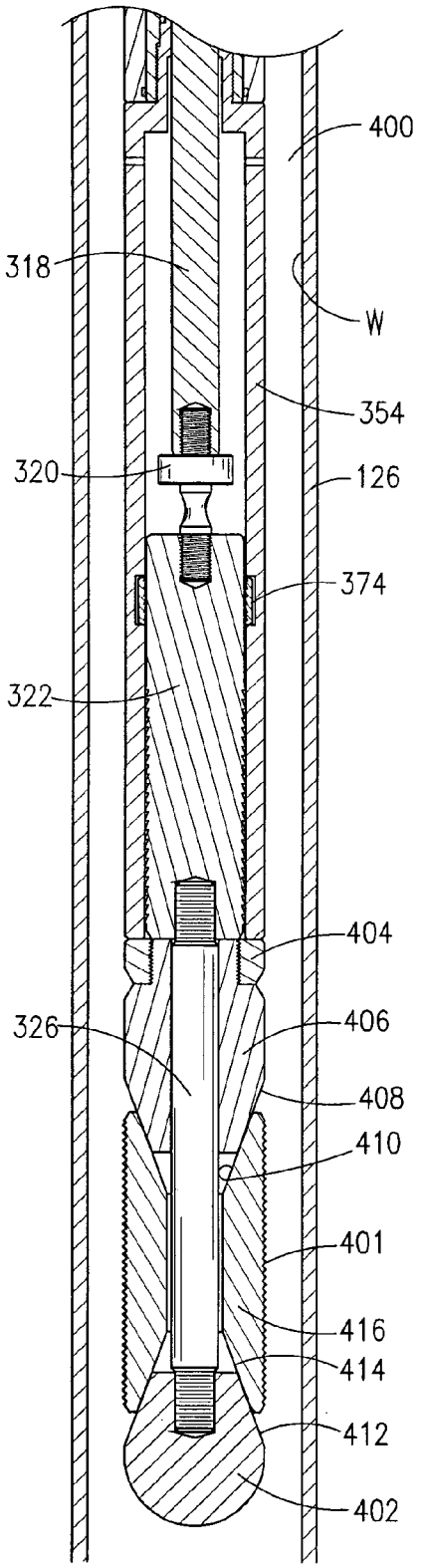
FIG. 19A is a cross-sectional view of a second embodiment of the bridge plug device seen in FIGS. 16A–16E.

Referring now to FIG. 19A, a cross-sectional view of a second embodiment of the bridge plug device 300 will now be described. The embodiment depicted in FIG. 19A is identical to the bridge plug embodiment 300 disclosed in FIGS. 16A–16E, except that the pivoting arm anchor 364 has been replaced with an anchor having slip means 400. In other words, the anchoring device of FIG. 19A utilizes slip means 400. Hence, the other components and operation of the bridge plug device 300 of FIG. 19A remain the same.

FIG. 19A shows the bridge plug device 300 being positioned at a point in the well, and in particular within the casing 126. The fourth mandrel 322 is shown connected to the tool mandrel 326. Also, the sixth housing 354 is shown. In the preferred embodiment, the slip means 401 may comprise a plurality of segments that are disposed about the tool mandrel 326. The slip means 400 have a tooth like profile 401 that engage and embed into the wall W of the casing 126, as is readily understood by those of ordinary skill in the art. Other designs of slip means are possible. For instance, it is possible that the slips be constructed of a single cylindrical member disposed about the tool mandrel 326.

In operation, the force applied to the tool via the explosive charge and/or hydraulic pressure, will in turn cause the tool mandrel 326 to experience an upward relative force, as previously set out. Also, the sixth housing 354 will be forced in a downward relative movement, as previously set out. The tool mandrel 326 has attached thereto the first wedge member 402, with the first wedge member being attached via thread means.

A collar 404 abuts the sixth housing 354, and the collar 404 is threadely attached to the second wedge member 406. Thus, as the housing 354 moves downward, the second wedge member 406, and in particular the face 408, will engage the inner face 410 of slip means 400 thereby expanding the slip means 400 radially outward into engagement with the wall W. Additionally, and at essentially the same time, the mandrel 326 has applied thereto a downward thereby exerting a relative downward force on the first wedge member 402 which in turn acts to engage the wedge face 412 against an opposing face 414 on the slip means 400, thereby radially expanding slip means 400 into engagement with casing 126.

Figure 19B:
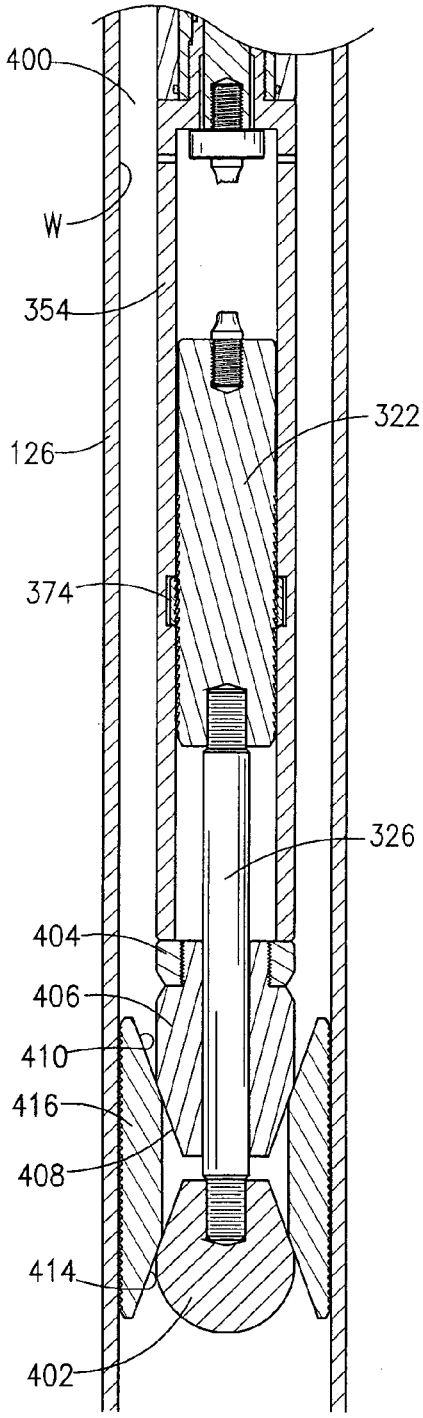
FIG. 19B is the cross-sectional view of FIG. 19A shown with the anchor being set.

FIG. 19B illustrates the sequential step of shearing the tension bolt 320. As mentioned earlier, the embodiment of FIGS. 19A and 19B are essentially identical execept for the use of the slip means 400. Hence, the step of shearing the tension bolt 320 is the same as previously described. Once the tension bolt 320 shears, the spiral device (housing 338 seen in FIG. 18D) can expand and also engage the walls as well as pulling out of the well 126 with the upper portion of the setting tool, all as previously described.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A down hole device comprising:

an outer tubular member having a series of slots therein, said slots being arranged about the exterior of said outer tubular member at an angle of inclination of between 25 degrees to 45 degrees;

an inner member disposed within said outer tubular member;

means for moving said outer tubular member in a first direction in order to subject the outer tubular member to a downward force so that the outer tubular member is expanded along said slot;

wherein said slots are arranged about said outer tubular member in a first spiral pattern which extends to a second spiral pattern.

2. A method of expanding an anchoring device within a casing, the anchoring device comprising: an outer tubular member having a series of slots therein, said slots being arranged about the exterior of said outer tubular member in a spiral pattern; an inner cylindrical member disposed within said outer tubular member; a setting apparatus comprising:

a setting sleeve connected to said outer tubular member; a mandrel being connected to said inner cylindrical member, a chamber positioned between said outer setting sleeve and said mandrel; and a ratchet means, disposed between said setting sleeve and said mandrel; the method comprising:

lowering the anchoring device to the desired level;

applying a first force to said inner cylindrical member in a first direction in order to subject the inner tubular member to an upward force;

applying a second force to said outer tubular member in a second direction in order to subject the outer tubular member to a downward force, and wherein the step of applying the first force and the second force comprises: applying a pressure to said chamber; and moving said setting sleeve downward in response to said hydraulic pressure and wherein the ratchet means allows movement of said setting sleeve in a first direction relative to said mandrel but prevents movement in a reverse direction;

expanding said outer tubular member along said slots;

engaging said outer tubular member against the inner wall of the casing.

3. The method of claim 2 wherein said spiral pattern is arranged in a first direction.

4. The method of claim 2 wherein said spiral pattern is arranged in a first spiral direction, and wherein said first spiral pattern extends to a second spiral direction.

5. The method of claim 2 wherein the anchoring device contains a plug device so that a flow stream from the casing is prevented from flowing through the anchoring device.

6. The method of claim 2 wherein the anchoring device contains a one way valve so that a flow stream from the casing is allowed to flow in a first direction through the anchoring device but is precluded from flowing in a second direction through the anchoring device.

7. The method of claim 2 wherein a cover material encases said outer tubular member and the cover material comprises an elastomeric member disposed about the outer tubular member and the step of engaging said outer tubular member against the inner wall of the casing further comprises sealingly engaging the elastomeric member against the inner wall of the casing.

8. The method of claim 2 wherein the outer tubular member has attached thereto a gravel pack screen and the method further comprises: placing a gravel pack slurry about the gravel pack screen.

9. A down hole device disposed within a well bore, the down hole device comprising:

an outer tubular having a series of spiral slots therein, said spiral slots being arranged about the outer portion of said outer tubular;

an inner tubular disposed within said outer tubular;

means for moving said outer tubular in a first direction in order to engage the shoulder so that a downward force is applied to the outer tubular thereby expanding the outer tubular along said spiral slots, and wherein said moving means comprises a setting tool having a setting sleeve connected to said outer tubular and a mandrel being connected to said inner tubular, and wherein said mandrel causes an upward force against the bottom end of said outer tubular and wherein said setting sleeve causes a downward force against the top end of said outer tubular so that said outer tubular expands along said spiral slots;

an elastomeric cover material member disposed about said outer tubular;

and wherein said spiral slots are arranged about said outer tubular in a first spiral pattern and wherein said first spiral pattern extends to a second spiral pattern.

10. The down hole device of claim 9 further comprising: stroke limit means, disposed between said setting sleeve and said mandrel, for terminating the movement of the mandrel in a first direction.

11. A method of expanding a down hole device within a well bore, the down hole device comprising: an outer tubular member having a series of spiral slots therein, said spiral slots being arranged about an exterior portion of said outer tubular member and wherein the angle of said spiral slots is between 25 degrees and 45 degrees, and an inner cylindrical member disposed within said outer tubular member the method comprising:

lowering the down hole device through an inner portion of a tubing, with the tubing being concentrically disposed within the well bore;

lowering the down hole device to the desired level within the well bore;

applying a first force to said inner cylindrical member in a first direction in order to subject the inner cylindrical member to an upward force;

applying a second force to said outer tubular members in a second direction in order to subject the outer tubular member to a downward force;

moving said outer tubular member in the second direction;

expanding the outer tubular member along said spiral slots, and wherein said expanded outer tubular member has an expanded outer diameter that is larger than the inner portion of the tubing;

contacting the exterior of said outer tubular member against the wall of the well bore; lifting the down hole device within the well bore;

cleaning the walls of the well bore with the exterior of said outer tubular member; pushing the down hole device down into the well bore;

cleaning the walls of the well bore with the exterior of said outer tubular member.

12. The method of claim 11 wherein an elastomeric member is disposed about the exterior of the outer tubular member and the step of expanding said exterior of said outer tubular member to engage the walls of the well bore further comprises sealingly engaging the elastomeric member against the wall of the well bore.

13. A down hole device for use in a well bore, the down hole device comprising:

an outer tubular member having a series of slots about the exterior of said outer tubular member, said slots being arranged at an angle offset from the longitudinal center of axis of the outer tubular member in a spiral mode and wherein said outer tubular member has an outer diameter portion less than an inner diameter portion of the well bore and wherein said slots are arranged about said outer tubular member in a first spiral pattern and wherein said first spiral pattern extends to a second spiral pattern;

an inner cylindrical member disposed within said outer tubular member;

means for moving said outer tubular member in a first direction in order to subject the outer tubular member to a first force thereby expanding the outer tubular member along said slots so that said expanded outer tubular member contacts the wall of the well bore;

a cover disposed about said outer tubular member.

14. The down hole device of claim 13 wherein said moving means comprises:

a setting tool having a setting sleeve connected to said outer tubular member and a mandrel being connected to said inner cylindrical member, and wherein said mandrel causes an upward force against the bottom end of said outer tubular member and wherein said setting sleeve causes a downward force against the top end of said outer tubular member so that said outer tubular member expands.

15. The down hole device of claim 14 further comprising:

ratchet means, disposed between said setting sleeve and said mandrel, for allowing movement of said setting sleeve in a first direction but preventing movement of said setting sleeve in a reverse direction.

16. The down hole device of claim 13 wherein said moving means comprises:

a setting apparatus comprising: a setting sleeve connected to said outer tubular member; a mandrel being connected to said inner tubular member; a chamber positioned between said outer tubular member and said inner tubular member; and wherein a pressure entering said chamber causes said setting sleeve to move downward so that said outer tubular member expands.

17. The down hole device of claim 16 further comprising an elastomeric member disposed about said cover.

18. A method of setting a plug within a casing, the plug comprising: a first anchoring device operatively associated with a second anchoring device, wherein said first anchoring device comprises a plurality of extendable arms and wherein said second anchoring device comprising: an outer tubular member having a series of spiral slots arranged about the exterior of said outer tubular member, said outer tubular member being attached to said first anchoring device; an inner member disposed within said outer tubular member; and wherein the method comprises:

lowering the plug to the desired level;

setting the first anchoring device at the desired level by extending the plurality of arms to engage the wall of the casing;

moving said outer tubular member in a first direction in order to subject the outer tubular member to a downward force;

expanding said outer tubular member along said slots;

engaging the outer diameter of said outer tubular member against the inner wall of the casing;

placing a slurry on the plug.

19. The method of claim 18 wherein said spiral slots are arranged in a first direction.

20. The method of claim 18 wherein said spiral slots are arranged in a first spiral direction, and wherein said first spiral direction extends to a second spiral direction.

21. A method of gravel packing a subterranean zone penetrated by a casing, the method comprising:

lowering an anchoring device to the desired level, the anchoring device comprising:

an outer tubular member having a series of slots therein, said slots being arranged about the exterior of said outer tubular member in a spiral pattern; an inner member disposed within said outer tubular member, said anchoring device having a gravel pack screen attached at a distal end;

moving said outer tubular member in a first direction in order to subject the outer tubular member to a downward force;

expanding said outer tubular member along said slots;

engaging the outer diameter of said outer tubular member against the inner wall of the casing;

placing a gravel pack slurry into the annulus of the casing.

22. The method of claim 21 wherein said anchoring device has a cover material disposed about the outer tubular member and wherein the step of engaging the outer diameter of said outer tubular member against the inner wall includes engaging said cover material against the inner wall.

23. The method of claim 22 wherein said cover material is made of a permeable material and the method further comprises:

flowing a portion of a production stream from the subterranean zone through said permeable material;

flowing the remaining portion of the production stream through an inner bore of said anchoring device.

24. The method of claim 22 wherein said cover material is made of an impermeable material and the method further comprises:

sealingly engaging said impermeable material against the wall of the casing;

flowing a production stream from the subterranean zone through an inner bore of said anchoring device.

25. The method of claim 22 wherein said spiral pattern is arranged in a first direction.

26. The method of claim 22 wherein said spiral pattern is arranged in a first spiral direction, and wherein said first spiral pattern extends to a second spiral direction.

27. An apparatus for use in a well comprising:

a first anchor member;

a second anchor member operatively associated with said first anchor member and wherein said second anchor member has contained thereon a plurality of slots formed in a spiral pattern;

setting tool means for setting said first anchor member and said second anchor member within the well;

and wherein said first anchor member has a first inner member and a first outer member and wherein said second anchor member has a second outer member attached to said first inner member and a second inner member attached to said first inner member and wherein said setting tool means includes first means for moving said first and second outer members in a first direction and second means for moving said first and second inner members in an opposing direction.

28. A method of gravel packing a subterranean zone penetrated by a casing, the method comprising:

placing a gravel pack screen within the casing, and wherein an annulus is formed within the casing;

placing a gravel pack slurry about said gravel pack screen;

lowering an anchoring device to the desired level, the anchoring device comprising:

an outer tubular member having a series of slots therein, said slots being arranged about the exterior of said outer tubular member in a spiral pattern; an inner member disposed within said outer tubular member, said anchoring device having a gravel pack screen attached at a distal end;

latching a distal end of said anchoring device onto the top of said gravel pack screen;

moving said outer tubular member in a first direction in order to subject the outer tubular member to a downward force;

expanding said outer tubular member along said slots;

engaging the outer diameter of said outer tubular member against the inner wall of the casing.

29. The method of claim 28 wherein said anchoring device has a cover material disposed about the outer tubular member and wherein the step of engaging the outer diameter of said outer tubular member against the inner wall includes engaging said cover material against the inner wall.

30. A method of expanding a down hole device within a well bore, the down hole device comprising: an outer tubular member having a series of spiral slots therein, said spiral slots being arranged about an exterior portion of said outer tubular member and wherein the angle of said spiral slots is between 25 degrees and 45 degrees, and an inner cylindrical member disposed within said outer tubular member; a ratchet means, operatively associated with said outer tubular member and said inner cylindrical member the method comprising:

lowering the down hole device through an inner portion of a tubing, with the tubing being concentrically disposed within the well bore;

lowering the down hole device to the desired level within the well bore;

applying a first force to said inner cylindrical member in a first direction in order to subject the inner cylindrical member to an upward force;

applying a second force to said outer tubular members in a second direction in order to subject the outer tubular member to a downward force;

moving said outer tubular member in the second direction, but preventing movement in a reverse direction by said ratchet means;

expanding the outer tubular member along said spiral slots, and wherein said expanded outer tubular member has an expanded outer diameter that is larger than the inner portion of the tubing;

contacting the exterior of said outer tubular member against the wall of the well bore.

31. The method of claim 30 wherein the down hole device contains a plug device so that a flow stream from the well bore is prevented from flowing through the down hole device.

32. A method of expanding a down hole device within a well bore, the down hole device comprising: an outer tubular member having a series of spiral slots therein, said spiral slots being arranged about an exterior portion of said outer tubular member and wherein the angle of said spiral slots is between 25 degrees and 45 degrees and wherein said spiral slots are arranged in a first spiral pattern that extends to a second spiral pattern, and an inner cylindrical member disposed within said outer tubular member, a setting apparatus comprising: an outer setting sleeve connected to said outer tubular member; a mandrel being connected to said inner cylindrical member; a chamber positioned between said outer setting sleeve and said mandrel; the method comprising:

lowering the down hole device through an inner portion of a tubing, with the tubing being concentrically disposed within the well bore;

lowering the down hole device to the desired level within the well bore;

applying a first force to said inner cylindrical member in a first direction in order to subject the inner cylindrical member to an upward force;

applying a second force to said outer tubular members in a second direction in order to subject the outer tubular member to a downward force;

moving said outer tubular member in the second direction by applying a pressure into said chamber, and moving said outer setting sleeve downward in response to said pressure;

expanding the outer tubular member along said spiral slots, and wherein said expanded outer tubular member has an expanded outer diameter that is larger than the inner portion of the tubing;

contacting the exterior of said outer tubular member against the wall of the well bore.

33. A method of expanding a down hole device within a well bore, the down hole device comprising: an outer tubular member having a series of spiral slots therein, said spiral slots being arranged about an exterior portion of said outer tubular member and wherein the angle of said spiral slots is between 25 degrees and 45 degrees, and an inner cylindrical memberdisposed within said outertubularmember; a one-way valve operatively associated with the inner cylindrical member, the method comprising:

lowering the down hole device through an inner portion of a tubing, with the tubing being concentrically disposed within the well bore;

lowering the down hole device to the desired level within the well bore;

applying a first force to said inner cylindrical member in a first direction in order to subject the inner cylindrical member to an upward force;

applying a second force to said outer tubular members in a second direction in order to subject the outer tubular member to a downward force;

moving said outer tubular member in the second direction;

expanding the outer tubular member along said spiral slots, and wherein said expanded outer tubular member has an expanded outer diameter that is larger than the inner portion of the tubing;

contacting the exterior of said outer tubular member against the wall of the well bore;

and wherein a flow stream from the well bore is allowed to flow in a first direction through said one way valve but is precluded from flowing in a second direction through said one way valve.

34. A method of expanding a down hole device within a well bore, the down hole device comprising: an outer tubular member having a series of spiral slots therein, said spiral slots being arranged about an exterior portion of said outer tubular member and wherein the angle of said spiral slots is between 25 degrees and 45 degrees, and an inner cylindrical member disposed within said outer tubular member, wherein the outer tubular member has attached thereto a gravel pack screen; the method comprising:

lowering the down hole device through an inner portion of a tubing, with the tubing being concentrically disposed within the well bore;

lowering the down hole device to the desired level within the well bore;

applying a first force to said inner cylindrical member in a first direction in order to subject the inner cylindrical member to an upward force;

applying a second force to said outer tubular members in a second direction in order to subject the outer tubular member to a downward force;

moving said outer tubular member in the second direction;

expanding the outer tubular member along said spiral slots, and wherein said expanded outer tubular member has an expanded outer diameter that is larger than the inner portion of the tubing;

contacting the exterior of said outer tubular member against the wall of the well bores pumping a gravel pack slurry about the gravel pack screen.

35. A method of setting a plug within a casing, the plug comprising: a first anchoring device operatively associated with a second anchoring device, wherein said first anchoring device comprises slip means having projections thereon, and wherein said second anchoring device comprising: an outer tubular member having a series of spiral slots arranged about the exterior of said outer tubular member, said outer tubular member being attached to said first anchoring device; an inner member disposed within said outer tubular member; and wherein the method comprises:

lowering the plug to the desired level;

setting the first anchoring device at the desired level, and wherein the step of setting the first anchoring device includes partially embedding said projections within the wall of the casing in order to engage the wall of the casing;

moving said outer tubular member in a first direction in order to subject the outer tubular member to a downward force;

expanding said outer tubular member along said slots;

engaging the outer diameter of said outer tubular member against the inner wall of the casing.

* * * * *